US010890060B2

(12) United States Patent
Jorud et al.

(10) Patent No.: US 10,890,060 B2
(45) Date of Patent: Jan. 12, 2021

(54) ZONE MANAGEMENT SYSTEM AND EQUIPMENT INTERLOCKS

(71) Applicant: Schlumberger Technology Corporation, Sugar Land, TX (US)

(72) Inventors: Anstein Jorud, Kristiansand (NO); Shunfeng Zheng, Katy, TX (US); Oerjan Eikeland, Kristiansand (NO)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 16/212,745

(22) Filed: Dec. 7, 2018

(65) Prior Publication Data

US 2020/0182039 A1 Jun. 11, 2020

(51) Int. Cl.
*E21B 44/10* (2006.01)
*E21B 41/00* (2006.01)

(52) U.S. Cl.
CPC ..... *E21B 44/10* (2013.01); *E21B 41/0021* (2013.01)

(58) Field of Classification Search
CPC . E21B 44/10; E21B 41/0021; G06T 2210/12; G06T 2210/21
See application file for complete search history.

(56) References Cited

U.S. PATENT DOCUMENTS 4,626,984 A 12/1986 Unruh et al.
4,794,534 A 12/1988 Millheim
4,875,530 A 10/1989 Frink et al.
5,154,233 A 10/1992 Gebhardt
5,467,832 A 11/1995 Orban et al.
5,590,958 A 1/1997 Dearing, Sr. et al.
5,842,149 A 11/1998 Harrell et al.
5,959,547 A 9/1999 Tubel et al.
6,029,951 A 2/2000 Guggari
6,050,348 A 4/2000 Richarson et al.
6,186,248 B1 2/2001 Silay
6,315,062 B1 11/2001 Alft et al.
6,338,390 B1 1/2002 Tibbitts
(Continued)

FOREIGN PATENT DOCUMENTS

EP 2458142 A2 5/2012
GB 2466338 A 6/2010
(Continued)

OTHER PUBLICATIONS

Stockhausen et al., "Continuous Direction and Inclination Measurements Lead to an Improvement in Wellbore Positioning", SPE/IADC 79917, SPE/IADC Drilling Conference, Feb. 2003, 16 pages.
(Continued)

*Primary Examiner* — James G Sayre
(74) *Attorney, Agent, or Firm* — Jeffrey D. Frantz

(57) ABSTRACT

Systems and methods for managing equipment in a workspace such as an oil rig are disclosed. Objects are given zones which are physically larger than the objects. A monitoring system is capable of monitoring the objects and the zones for each object. When zones intersect, a collision is possible and the monitoring system can take action to prevent the collision or mitigate damage in the case of a collision. Further, systems and methods for ensuring the moving components are handed-off properly from one support to another are disclosed.

14 Claims, 16 Drawing Sheets

(56) References Cited

U.S. PATENT DOCUMENTS 6,374,925 B1 4/2002 Elkins et al.
6,382,331 B1 5/2002 Pinckard
6,484,816 B1 11/2002 Koederitz
6,519,568 B1 2/2003 Harvey et al.
6,626,238 B2 9/2003 Hooper
6,629,572 B2 10/2003 Womer et al.
6,662,110 B1 12/2003 Bargach et al.
6,732,052 B2 5/2004 Macdonald et al.
6,803,760 B2 10/2004 Jones et al.
6,892,812 B2 5/2005 Niedermayr et al.
6,896,055 B2 5/2005 Koithan
6,925,807 B2 8/2005 Jones et al.
6,931,621 B2 8/2005 Green et al.
6,944,547 B2 9/2005 Womer et al.
6,958,677 B1 10/2005 Carter
6,994,172 B2 2/2006 Ray
7,026,950 B2 4/2006 Guggari et al.
7,038,965 B2 5/2006 Shih
7,044,237 B2 5/2006 Leuchtenberg
7,054,750 B2 5/2006 Rodney et al.
7,059,427 B2 6/2006 Power et al.
7,100,708 B2 9/2006 Koederitz
7,114,577 B2 10/2006 Newman
7,138,925 B2 11/2006 Nield
7,152,696 B2 12/2006 Jones
7,172,037 B2 2/2007 Dashevskiy et al.
7,243,735 B2 7/2007 Koederitz et al.
7,264,050 B2 9/2007 Koithan et al.
7,278,496 B2 10/2007 Leuchtenberg
7,306,054 B2 12/2007 Hutchinson
7,357,196 B2 4/2008 Goldman et al.
7,367,411 B2 5/2008 Leuchtenberg
7,404,454 B2 7/2008 Hulick
7,461,705 B2 12/2008 Hulick et al.
7,588,100 B2 9/2009 Hamilton
7,591,304 B2 9/2009 Juhasz et al.
7,672,262 B2 3/2010 McCoy et al.
7,677,331 B2 3/2010 Lowe et al.
7,823,655 B2 11/2010 Boone et al.
7,860,593 B2 12/2010 Boone
7,874,351 B2 1/2011 Hampton et al.
7,895,220 B2 2/2011 Evans et al.
7,896,084 B2 3/2011 Haugen
7,938,197 B2 5/2011 Boone et al.
7,945,488 B2 5/2011 Karr et al.
8,042,623 B2 10/2011 Quernheim et al.
8,103,493 B2 1/2012 Sagert et al.
8,121,971 B2 2/2012 Edwards et al.
8,131,510 B2 3/2012 Wingky et al.
8,145,464 B2 3/2012 Arnegaard et al.
8,154,419 B2 4/2012 Daussin et al.
8,210,283 B1 7/2012 Benson et al.
8,215,417 B2 7/2012 Annaiyappa et al.
8,286,730 B2 10/2012 Pool et al.
8,301,386 B1 10/2012 Redmond et al.
8,347,957 B2 1/2013 Stephenson et al.
8,360,171 B2 1/2013 Boone et al.
8,381,838 B2 2/2013 Hutniak et al.
8,386,059 B2 2/2013 Boone
8,387,720 B1 3/2013 Keast et al.
8,417,456 B2 4/2013 Mauldin et al.
8,590,635 B2 11/2013 Koederitz
8,602,126 B2 12/2013 Boone et al.
8,616,274 B2 12/2013 Belcher et al.
8,718,802 B2 5/2014 Boone
8,794,353 B2 8/2014 Benson et al.
8,818,779 B2 8/2014 Sadlier et al.
8,939,234 B2 1/2015 Mebane, III et al.
9,027,671 B2 5/2015 Koederitz
9,062,524 B2 6/2015 Calvo et al.
9,157,309 B1 10/2015 Benson et al.
9,175,557 B2 11/2015 Iversen et al.
9,223,594 B2 12/2015 Brown et al.
9,249,654 B2 2/2016 Strachan et al.
9,285,794 B2 3/2016 Wang et al.
9,290,995 B2 3/2016 Boone et al.
9,322,247 B2 4/2016 Rojas et al.
9,359,881 B2 6/2016 DiSantis
9,388,681 B2 7/2016 Dykstra et al.
9,410,417 B2 8/2016 Reckmann et al.
9,410,418 B2 8/2016 Papouras et al.
9,436,173 B2 9/2016 Wang et al.
9,441,428 B1 9/2016 Barnes et al.
9,464,492 B2 10/2016 Austefjord et al.
9,464,517 B2 10/2016 Papouras et al.
9,482,083 B2 11/2016 Doris
9,506,336 B2 11/2016 Orbell
9,528,334 B2 12/2016 Davis et al.
9,593,566 B2 3/2017 Hoehn et al.
9,593,567 B2 3/2017 Pink et al.
9,598,947 B2 3/2017 Wang et al.
9,657,539 B2 5/2017 Gupta et al.
2003/0212898 A1 11/2003 Steele et al.
2004/0055986 A1* 3/2004 Lamb ..... G08G 7/02 212/276
2004/0144529 A1 7/2004 Barnes et al.
2007/0017682 A1 1/2007 Abrahamsen et al.
2007/0062692 A1 3/2007 Estevez et al.
2008/0105427 A1 5/2008 Hampton et al.
2010/0104401 A1 4/2010 Hopkins et al.
2010/0121861 A1 5/2010 Marsden et al.
2010/0147589 A1 6/2010 Wingky
2010/0289662 A1 11/2010 Dasilva et al.
2011/0162888 A1 7/2011 McHugh et al.
2012/0026002 A1 2/2012 Vu et al.
2012/0123563 A1 5/2012 Drinkard
2012/0138362 A1 6/2012 Koederitz
2012/0203507 A1 8/2012 Thomeer et al.
2013/0146358 A1 6/2013 DiSantis
2013/0231781 A1 9/2013 Chapman
2013/0231787 A1 9/2013 Chapman et al.
2014/0077964 A1 3/2014 Beligere et al.
2014/0099175 A1 4/2014 Guidry
2014/0151121 A1 6/2014 Boone et al.
2014/0246238 A1 9/2014 Abbassian et al.
2014/0299378 A1 10/2014 Abbassian et al.
2014/0348385 A1* 11/2014 Kozicz ..... E21B 19/00 382/103
2015/0015412 A1 1/2015 Abbassian et al.
2015/0105912 A1 4/2015 Dykstra
2015/0158428 A1 6/2015 Beggs et al.
2015/0241871 A1 8/2015 Yoshino et al.
2015/0252664 A1 9/2015 Astrid et al.
2015/0315855 A1 11/2015 Dewald et al.
2015/0345262 A1 12/2015 Kpetehoto et al.
2015/0345281 A1 12/2015 Cardellini et al.
2015/0369030 A1 12/2015 Hay et al.
2016/0024906 A1 1/2016 Jamison et al.
2016/0034818 A1 2/2016 Knecht et al.
2016/0047220 A1 2/2016 Sharp et al.
2016/0076354 A1 3/2016 Lai et al.
2016/0130917 A1 5/2016 Torrione
2016/0160627 A1 6/2016 Aitken
2016/0168973 A1 6/2016 Dykstra et al.
2016/0194950 A1 7/2016 Zheng et al.
2016/0222775 A1 8/2016 Tunc et al.
2016/0230530 A1 8/2016 Dykstra et al.
2016/0237802 A1 8/2016 Boone et al.
2016/0275133 A1 9/2016 Moore
2016/0290046 A1 10/2016 Orban et al.
2016/0290073 A1 10/2016 Zheng et al.
2016/0290119 A1 10/2016 Tunc et al.
2016/0290120 A1 10/2016 Zheng et al.
2016/0291201 A1 10/2016 Tunc et al.
2016/0292513 A1 10/2016 Kozicz et al.
2016/0292933 A1 10/2016 Sprock et al.
2016/0321330 A1 11/2016 Ziegler et al.
2016/0333673 A1 11/2016 Anno et al.
2016/0356125 A1 12/2016 Bello et al.
2016/0369619 A1 12/2016 Parmeshwar et al.
2017/0002649 A1 1/2017 Sund
2017/0114632 A1 4/2017 Orban et al.
2017/0122092 A1 5/2017 Harmer
2017/0147963 A1 5/2017 Altamirano et al.

(56) References Cited

U.S. PATENT DOCUMENTS

| | | | | |
|---|---|---|---|---|
| 2017/0159372 | A1 | 6/2017 | Zheng et al. | |
| 2017/0167200 | A1 | 6/2017 | Zheng et al. | |
| 2017/0167853 | A1 | 6/2017 | Zheng et al. | |
| 2017/0337820 | A1* | 11/2017 | Glatfelter | B66F 17/003 |
| 2018/0149010 | A1 | 5/2018 | Zheng et al. | |
| 2018/0171760 | A1 | 6/2018 | Zheng et al. | |
| 2019/0018871 | A1 | 1/2019 | Zheng et al. | |
| 2019/0073912 | A1* | 3/2019 | Mellinger, III | G08G 5/0021 |
| 2019/0078429 | A1 | 3/2019 | Zheng et al. | |
| 2019/0136650 | A1 | 5/2019 | Zheng et al. | |
| 2019/0249538 | A1* | 8/2019 | Menard | G05B 19/4061 |
| 2020/0157893 | A1 | 5/2020 | Jorud | |

FOREIGN PATENT DOCUMENTS

| | | | |
|---|---|---|---|
| WO | 2004059123 | A1 | 7/2004 |
| WO | 2007024779 | A1 | 3/2007 |
| WO | 2015123045 | A1 | 8/2015 |
| WO | 2016102381 | A1 | 6/2016 |
| WO | 2016106294 | A1 | 6/2016 |
| WO | 2016130160 | A1 | 8/2016 |
| WO | 2016172038 | A1 | 10/2016 |
| WO | 2017132297 | A2 | 8/2017 |
| WO | 2017223257 | A1 | 12/2017 |

OTHER PUBLICATIONS

Genevois et al., "Gyrostab Project: The Missing Link—Azimuth and inclination mastered with new principles for standard roatry BHAs", SPE/IADC 79915, SPE/IADC Drilling Conference, Feb. 2003, 11 pages.

Aguiar et al., "On the Benefits of Automation in Improving the Driling Effieciency in Offshore Activities", IADC/SPE 168025, 2014 IADC/SPE Drilling Conference and Exhibition, Mar. 2014, 12 pages.

Brett et al., "Field Experiences With Computer-Controlled Drilling", SPE 20107, 1990 Permian Basin Oil and Gas Recovery Conference, Mar. 1990, pp. 197-212.

Halsey et al., "Torque Feedback Used to Cure Slip-Stick Motion", SPE 18049, 63rd Annual Technical Conference and Exhibition of the Petroleum Engineers, Oct. 1988, pp. 277-282.

Jones et al., "Stick-Slip and Torsional Oscillation Control in Challenging Formation—A New Solution to an Old Problem", AADE-17-NTCE-076, 2017 AADE National Technical Conference and Exhibition, Apr. 2017, 10 pages.

* cited by examiner

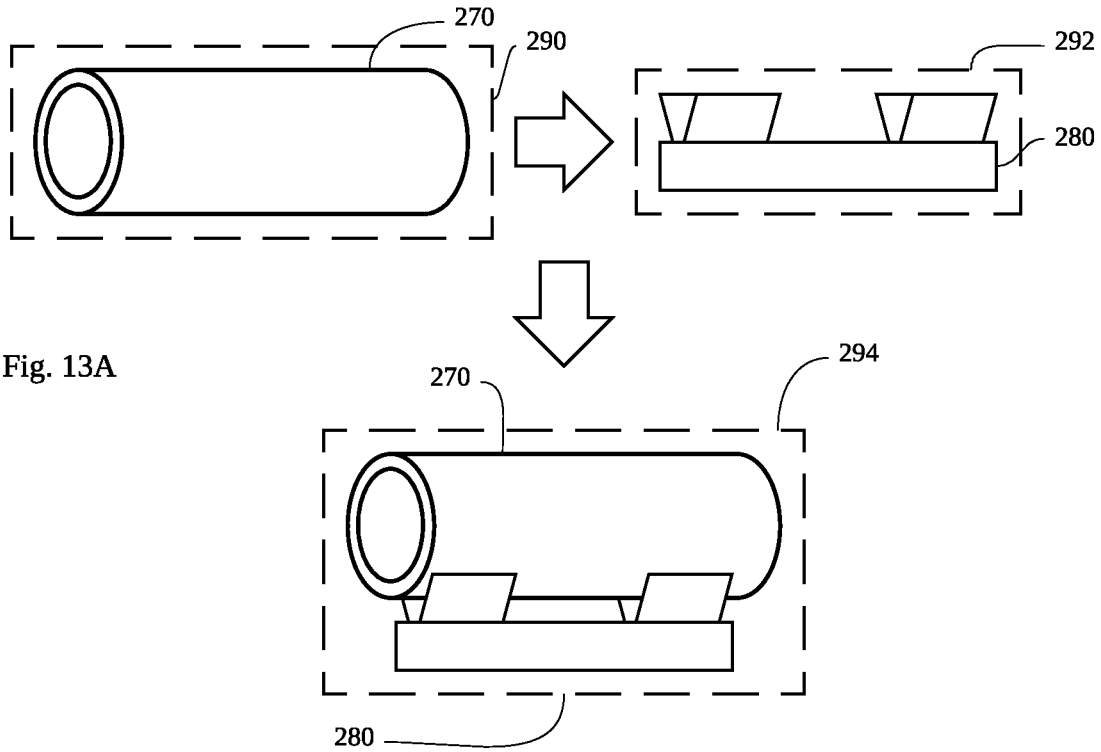
Fig. 13A
Fig. 13B
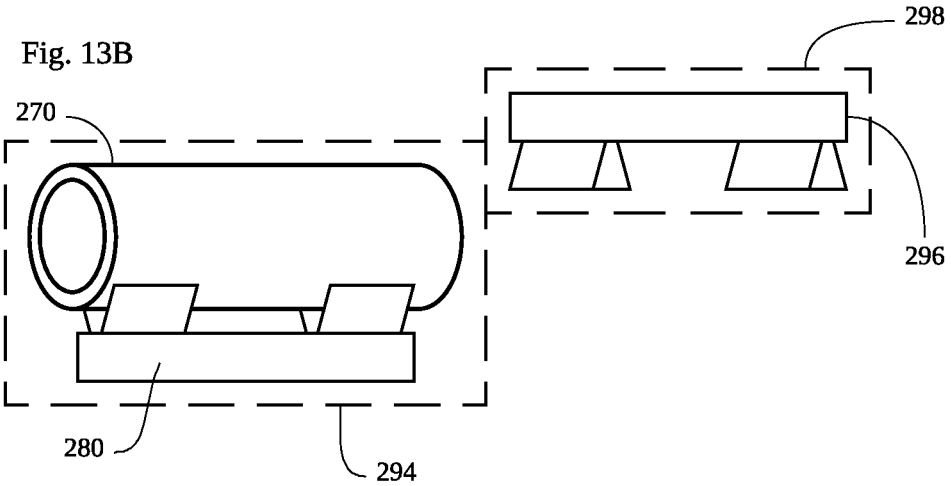
Fig. 13C
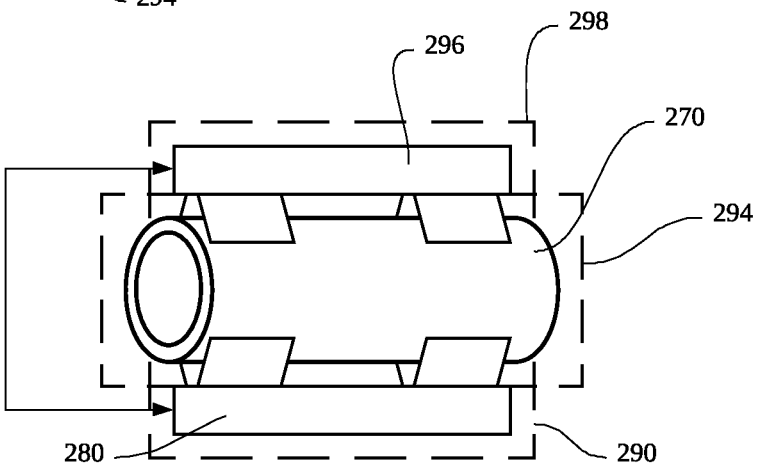

ZONE MANAGEMENT SYSTEM AND EQUIPMENT INTERLOCKS

BACKGROUND

Drilling rigs used for oil and gas production are complicated and sometimes dangerous machines. There are many moving parts that operate together in concert in order to carry out the drilling operation, such as iron roughnecks, top drives, mud pumps, electrical systems, and tools. Certain areas of a rig floor are high-traffic areas where many of these moving parts operate at different times and in different ways, but all portions of a rig are potential danger areas without proper care. Maintaining order and avoiding collisions and other inefficiencies is a challenging and yet important endeavor.

SUMMARY

Embodiments of the present disclosure are directed to a system comprising a plurality of monitored objects, each having physical characteristics, the monitored objects being deployed in a workspace such as an oil rig. The system also includes a computation component configured to establish zones pertaining to one or more of the monitored objects according to the physical characteristics, and a memory configured to store a coordinate system for the workspace and for the monitored objects and to store information describing the zones. The zones extend beyond a physical extremity of the monitored object in at least one direction, and the computation component is configured to identify that zones for two or more monitored objects will intersect. The computation component is further configured to initiate preventive measures in response to the zones intersecting.

Further embodiments of the present disclosure are directed to a method including identifying a coordinate system for a workspace, identifying a plurality of monitored objects within the workspace, and establishing coordinates for the monitored objects pertaining to the coordinate system for the workspace. The method also includes establishing a zone for one or more monitored objects, the zone extending beyond a perimeter of the monitored object such that a buffer is defined between the zone and the monitored object, and identifying intersection of two or more zones. The method also includes initiating preventive measures in response to the intersection.

Embodiments of the present disclosure are directed to a system including a computation component configured to calculate the size and shape of a plurality of objects at a rig site and to identify a zone pertaining to each of the objects. The zone is larger than the objects in at least one dimension. The computation component is also configured to monitor movement of the objects, identify when the zones of two or more objects intersects, and issue an alarm in response to the intersection.

Further embodiments of the present disclosure are directed to a system including a computation component configured to calculate the size and shape of a plurality of objects at a rig site and to identify a zone pertaining to each of the objects. The zone is larger than the objects in at least one dimension. The computation component is further able to monitor movement of the objects and to identify when the zones of two or more objects intersects. The computation component can issue an alarm in response to the intersection.

Still further embodiments of the present disclosure are directed to a system for transferring a tubular between two support structures. The system includes a first support structure configured to secure and transport a tubular, the tubular being configured to join with other tubulars to form a drillstring at a rig site, and a second support structure configured to receive the tubular from the first support structure. The system also includes communication means configured to facilitate communication between the first and second support structures. The first support structure receives confirmation from the second support structure that the second support structure has secured the tubular and does not release the tubular until receiving the confirmation. The first support structure is configured to release the tubular after receiving the confirmation.

Yet other embodiments of the present disclosure are directed to a method including securing a tubular with a support, the tubular being configured to join with other tubulars to form a drillstring, and initiating a transfer of the tubular from the support to a second support. The method also includes requesting confirmation from the second support that the tubular has been satisfactorily secured to the second support, and securing the tubular to the second support. The method continues by confirming to the support that the second support has secured the tubular, and after receiving the confirmation, releasing the tubular by the support.

Other embodiments of the present disclosure are directed to a system including a support configured to hold a tubular, the tubular being configured to join with other tubulars to form a drillstring for an oilfield drilling operation, and a transmitter being coupled to the support. The transmitter is configured to communicate with other supports. The support is configured to deliver the tubular to a second support, communicate with the second support, and request a confirmation from the second support that the tubular is secure. After receiving the confirmation, the support will release the tubular.

BRIEF DESCRIPTION OF THE FIGURES

FIG. 13A illustrates a tubular and a support according to embodiments of the present disclosure.

FIG. 13B shows a composite zone, a tubular, a support and a second support and corresponding zone according to embodiments of the present disclosure.

FIG. 13C shows a transfer sequence between the first support 280 and the second support.

DETAILED DESCRIPTION

Figure 1:
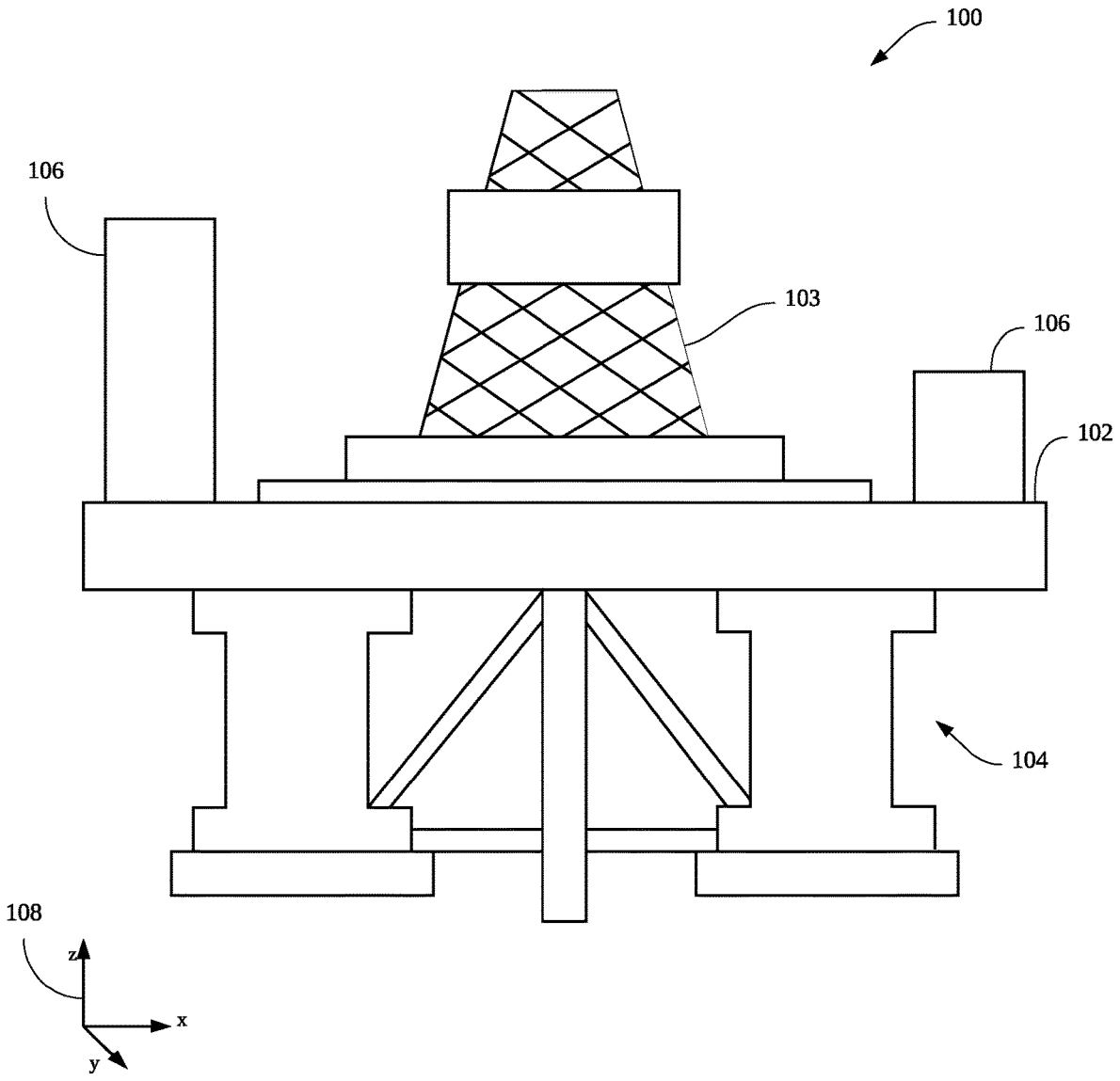
FIG. 1 is a schematic representation of an oil rig according to embodiments of the present disclosure.

Below is a detailed description according to various embodiments of the present disclosure. FIG. 1 is a schematic representation of an oil rig 100 according to embodiments of the present disclosure. The rig 100 can have a rig floor 102, a tower 103, and support structures 104. There may be equipment 106 on the rig floor 102 or suspended from the tower 103 or in virtually any place on, above, or around the rig 100. The systems and methods of the present disclosure can be applied to any equipment of the rig 100 as will become clear throughout this disclosure. The rig 100 can be given a coordinate system 108 which can be an x-y-z coordinate system or another suitable coordinate system such as polar or azimuth. The coordinate system 108 can be arbitrarily assigned to the rig 100 based on a reference point, or based on GPS coordinates which relate to global coordinates. One possible reference point is a generally vertical line known as "well center" that defines the center of the bore drilled by the rig 100.

Embodiments of the present disclosure are directed toward systems and methods of monitoring equipment on the rig of all sizes, shapes, etc. According to the present disclosure, systems and methods define a zone for each object. The zone is a three dimensional space defined according to the coordinate system 108. Each zone pertains to one or more different pieces of equipment, including those structures or components what are stationary as part of the drilling rig. The zone is attached to the equipment and travels with the equipment. The size of the zone may change (expand or shrink) depending on the speed of the equipment it is attached to, or the speed of the surrounding equipment that may come in contact with the associated equipment. Some machinery and equipment is complex enough to warrant using multiple zones within the machinery, and the systems of the present disclosure can maintain information pertaining to the zones of the different subcomponents. The systems and methods are configured to monitor the zones to prevent collision between the parts as will be described herein below. Without loss of generality, it is possible to use multiple different coordinate systems to implement zone management on the rig. For example, coordinate system 1 may be used to implement zone management between equipment A and B, while a different coordinate system 2 may be used to implement zone management among equipment A, C and D.

Figure 2B:
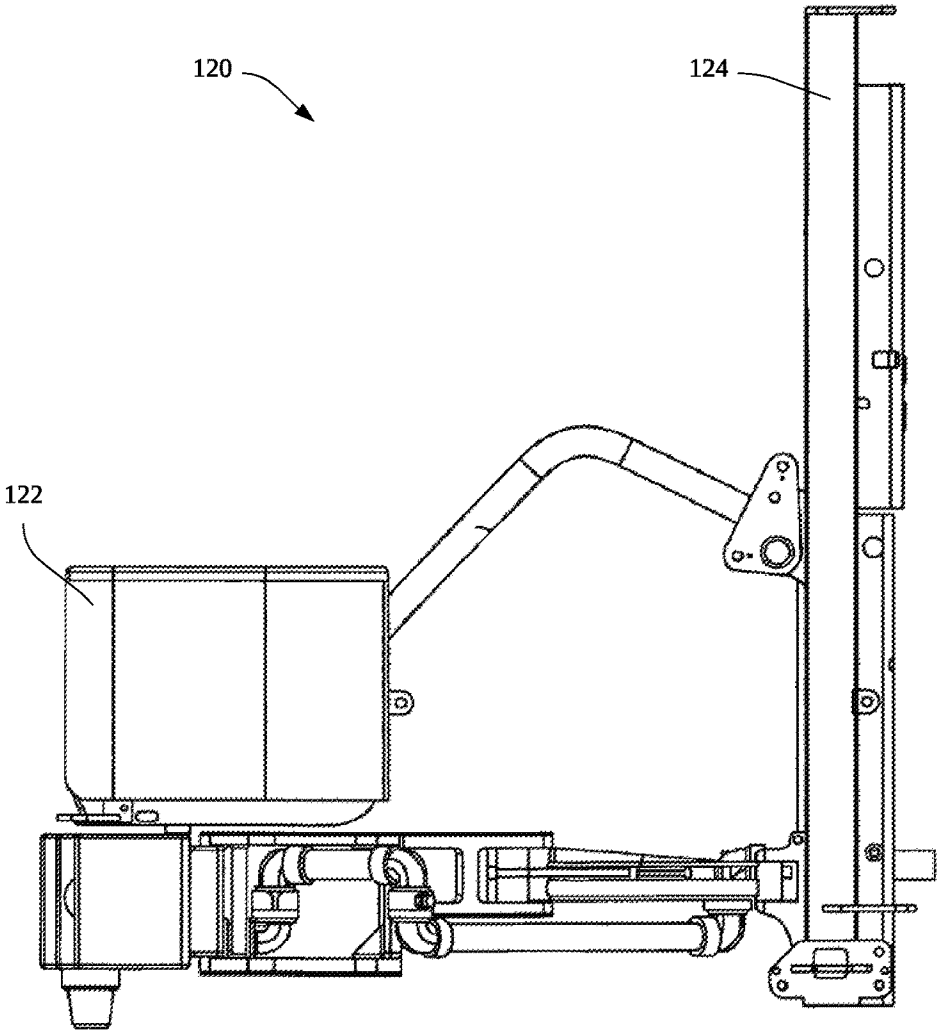
FIGS. 2A and 2B are illustrations of an iron roughneck in contracted and expanded configurations, respectively, according to embodiments of the present disclosure.
Figure 2A:
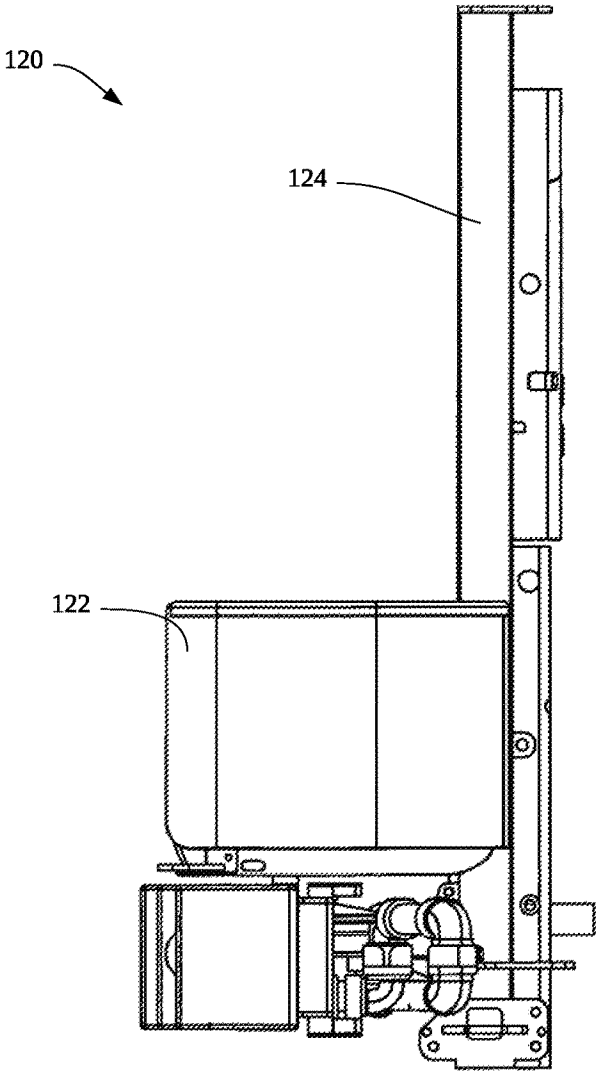

FIGS. 2A and 2B are illustrations of an iron roughneck 120 in contracted and expanded configurations, respectively, according to embodiments of the present disclosure. The iron roughneck 120, like other components on the rig, can expand and/or move in various ways. It has a gripping portion 122 and a support mechanism 124. When contracted (FIG. 2A), the gripping portion 122 is closer to the support 124 than when expanded (FIG. 2B). The iron roughneck 120 may also translate and rotate around the rig. Iron roughnecks such as that shown here are generally used to grip tubes and to make up thread connections. The Iron roughneck 120 is used in this figure to illustrate movement of a component on the rig. It is to be understood that an oil rig can employ equipment of virtually any description, some of which moves in certain ways and has different sizes, positions, weights, functions, etc. The iron roughneck 120 is shown to illustrate an example of a component of a rig and is not used in a limiting sense.

Figure 3B:
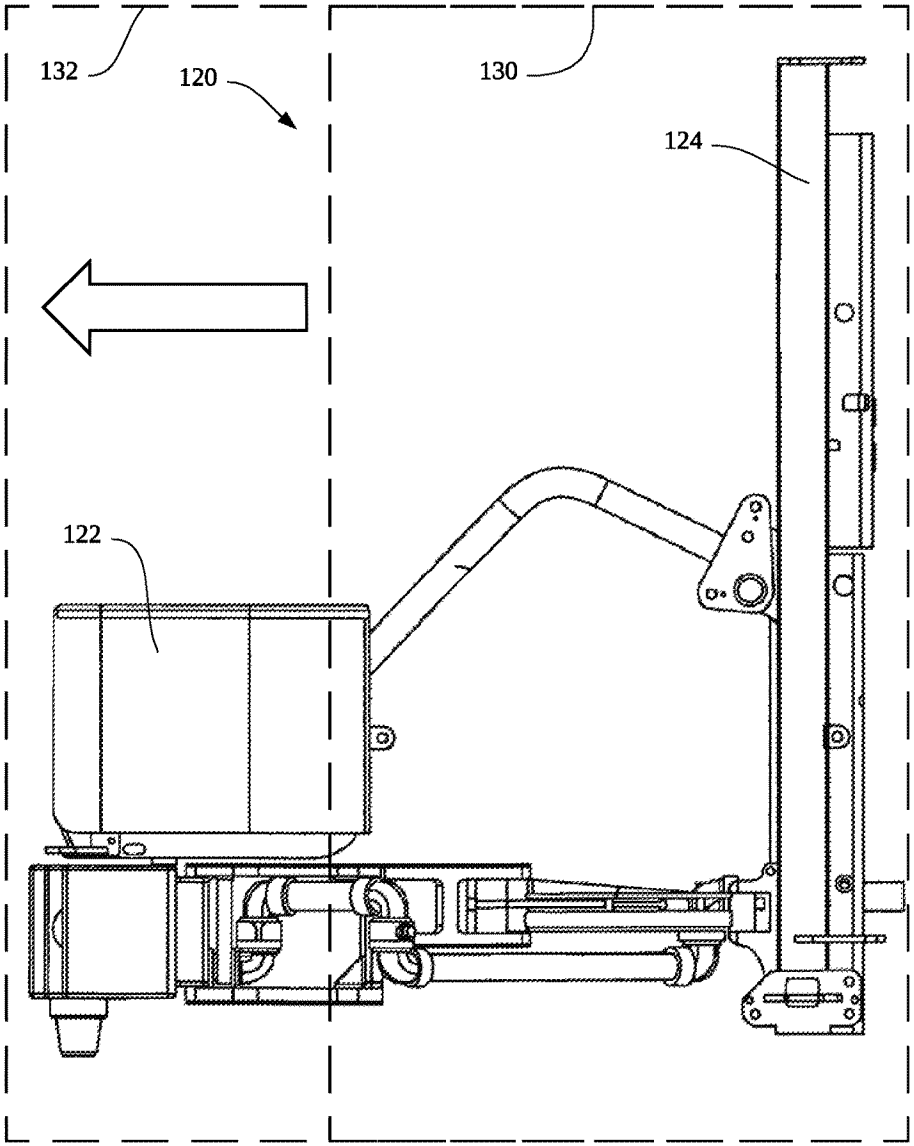
FIGS. 3A and 3B are illustrations of a zone for the iron roughneck according to embodiments of the present disclosure.
Figure 3A:
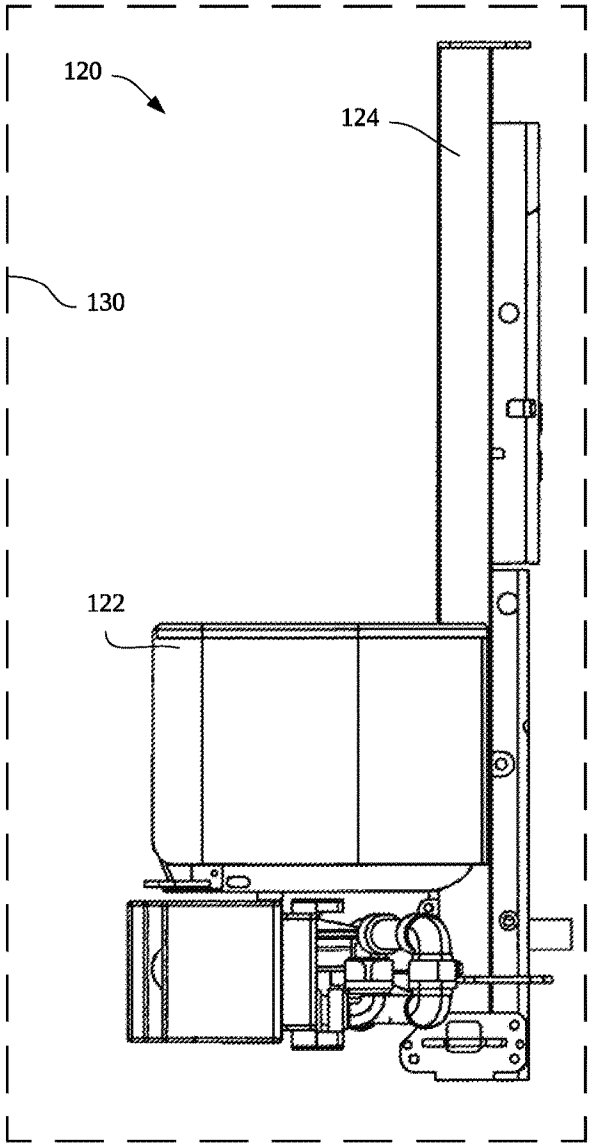

FIGS. 3A and 3B are illustrations of a zone 130 for the iron roughneck 120 according to embodiments of the present disclosure. In FIG. 3A, the iron roughneck 120 is contracted and the zone 130 is defined to surround the iron roughneck 120. The zone 130 can be a cube having six generally planar limits as defined in the coordinate system, or it can be a more complex shape that perhaps more closely matches the shape of the equipment. Alternatively, the zone 130 may not fully surround the whole iron roughneck 120. Instead, the zone may only cover the portion of the iron roughneck 120 that could potentially collide with other rig equipment. In FIG. 3B the iron roughneck 120 is expanded. As the iron roughneck moves and/or expands, the zone 130 moves and/or expands with the iron roughneck. The extent of the expansion could depend on the speed of the iron roughneck movement. The zone 132 can be modified to account for the changes to the shape, position, or orientation of the iron roughneck 120.

Figure 4:
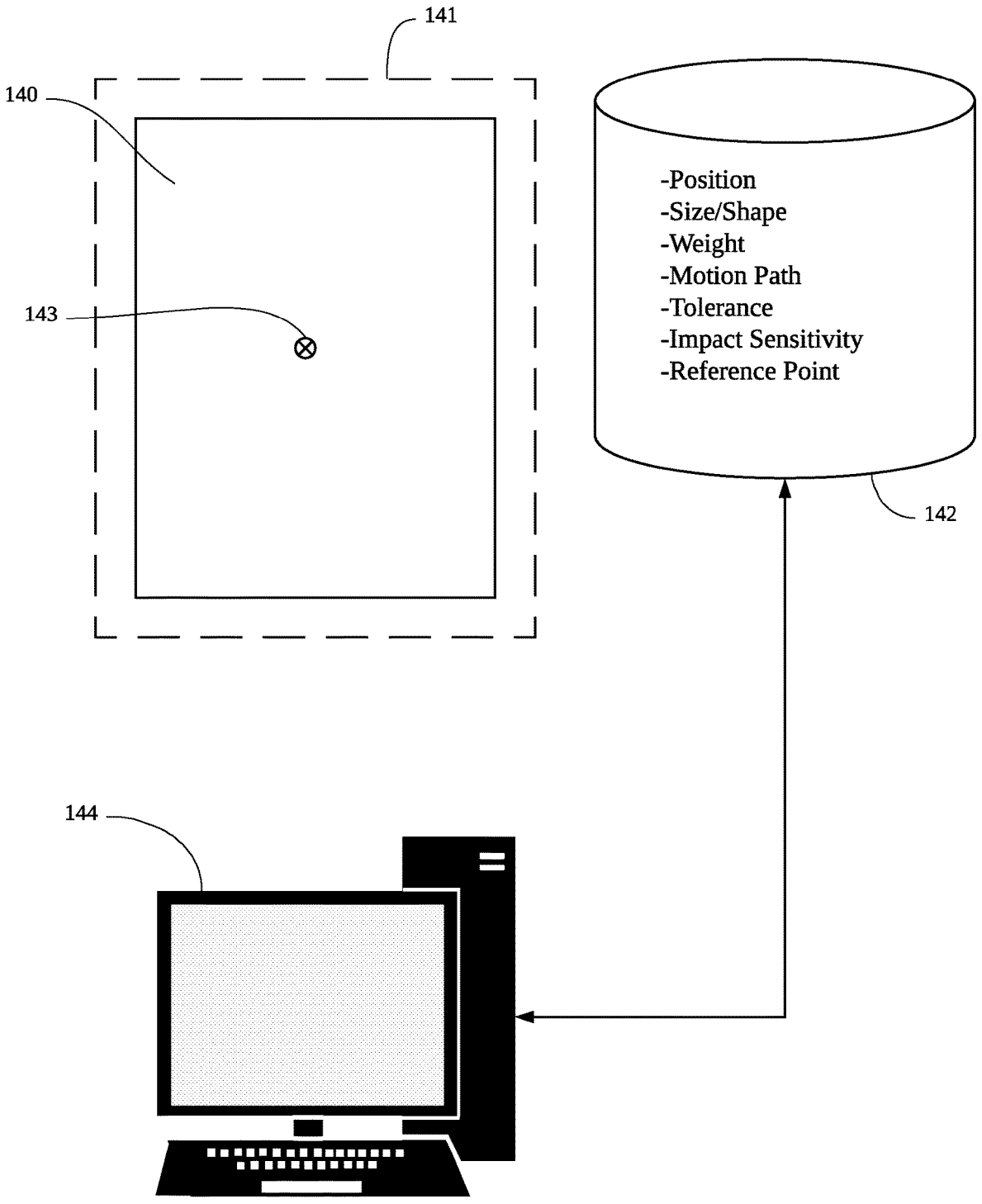
FIG. 4 depicts a component that is the subject of the systems and methods of the present disclosure.

FIG. 4 depicts a component 140 that is the subject of the systems and methods of the present disclosure. The component 140 can be any component present on an oil rig. There are many components in use at any time on an oil rig. Many of them have different dimensions, weights, and purposes. Some of the components are stationary on the rig; some of them move. The component 140 has a zone 141 that at least partially envelops the component 140. The zone 141 may be larger than the component 140 such that a buffer zone is created between the extremities of the component 140 and the zone 141 to further help to avoid an unwanted collision between components. According to embodiments of the present disclosure, a database 142 is used to store characteristics of the components on the rig. The database 142 may store information related to position, size, shape, weight, motion path, tolerance, impact sensitivity, reference point, center of mass 143, and attachment points. In embodiments the systems and methods include a computation component 144 configured to execute logic and calculations according to the present disclosure.

Position

The position of the component 140 can be expressed in terms of coordinates relative to a coordinate system as shown in FIG. 1. The coordinate system can be an x-y-z system, a polar coordinate system, or another suitable type of coordinate system. The coordinate system of the rig can be centered on any arbitrary point such as a north-west extreme, the intersection of drill center and the rig floor, or any other arbitrary coordinate system. The position of the component 140 is monitored and continuously compared against the position of other relevant components on the rig. The position information of a component, in conjunction with the size, and/or shape information of the component, may be used to describe the equipment and its associated zone in the three dimensional space of the coordinate system in relation to other components on the rig. The systems and methods of the present disclosure can detect if a collision between two or more components is imminent and if so, issue a warning or take action to prevent the collision.

Size and Shape

The size of a component can be stored by the database 142 to help calculate the zone 141. The database 142 can store the size of the component 140 in terms of coordinates at various extremities of the component 140. In the case that the component 140 has a cubic shape, the size can be described by the edges and the orientation of the cube or any other suitable coordinate system. The shape of the component 140 may be more complex and in such cases, more coordinates can be used to calculate the size and shape of the component 140. Virtually any shape and size of component can be tracked by the systems and methods of the present disclosure. The size and/or shape information of a component is used to define the corresponding size and/or shape of the associated zone. The zone may fully envelop the physical component. Alternatively, the zone may only cover a part of the physical component that may collide with other components. Furthermore, the size of the zone may expand in the direction aligned with the movement of the component. Alternatively, the size of the zone in a component may expand in the direction of another approaching component. The extent of this expansion may depend on the speed of the moving component.

Weight

The database 142 can further track the weight of the component 140 which can be used to determine how much force is required to move or stop motion of the component 140. In some embodiments the weight is known ahead of time, and in other embodiments the rig is equipped with sensors configured to determine the weight of the component 140 at any desired time. For example, if the component 140 is a top drive connected to a drillstring, the weight of the component 140 varies depending on the length of the drillstring. The sensors can take measurements at any desired time to determine weight as needed.

Motion Path

The position of the various components on the rig varies from time to time. The motion path of the component 140 can also be stored by the database 142. The motion path of the component 140 could be a complete path where the component 140 could travel from one position to another position. Alternatively the motion path of the component 140 could be just the direction in which the component may travel with no defined end point. The database 142 can store a routine path of motion for a given component. For example, an iron roughneck as shown in FIGS. 2 and 3 has a movement path from the contracted and expanded positions. The trajectory of the path can be known ahead of time. The computation component 144 can be informed of a proposed motion path for a given component and can calculate whether or not the component 140 can make the proposed movement at the proposed time without intersecting with a zone of another component on the rig. If so, the computation component 144 approves the movement. Alternatively, when the component 140 is commanded to move in a particular direction, the zone associated with this component may be expanded in the direction of the intended movement. The extent of zone expansion may depend on the speed of the associated component. With the expanded zone for component 140, the computation component 144 can calculate whether this expanded zone for component 140 could intersect with a zone of another component on the rig. If not, the computation component 144 approves the movement. In another embodiment, when the component 140 is commanded to move in a particular direction, the zones associated all surrounding components that may come in contact with component 140 may be expanded in the direction of the incoming component 140. The extent of the zone expansion may depend on the speed of the incoming component. The computation component 144 could perform similar calculation to evaluate whether any zone intersection may occur and react accordingly. The movement of the components can be under the direction and control of one or more different mechanisms, some of which move under their own power such as the iron roughneck shown previously. The movement mechanisms in their various forms can be subject to the approval of the computation component to prevent collisions between components.

In some embodiments the movement of one or more portable components may be unscheduled. A portable component is any object that is not part of a typically rig equipment, but may be present on the rig during the operation. For example, a rig worker could be a portable object, which may enter the rig floor to interact with other rig equipment in an ad hoc basic. A crate could be a portable object, which may be brought to the rig floor during the operation. The systems and methods of the present disclosure are equipped to detect and monitor even unscheduled movement of a portable object. Cameras, sensors, and other measuring equipment can be used to identify the object and detect its movement. The computation component 144 can establish a zone associated with this object, evaluate its risk for colliding with surrounding equipment and can issue a warning and take action to prevent a collision. The computation component 144 may move other components out of the way, or it may stop the movement of other components, to avoid a collision. The computation component 144 can also be configured to calculate an expected damage for a given collision and can be configured with logic to allow the computation component 144 to determine a course of action under a given set of circumstances. For example, suppose the top drive is moving down toward the rig floor when the computation component 144 detects a rig worker walking toward the well center. The computation component 144 immediately establishes a zone around the rig worker and evaluate whether or not this zone would intersect with the zone associated with the top drive. Depending on safety policy established for the operation, the computation component may take a number of measures to avoid collision between the top drive and the rig worker, from raising alarm, slowing down the movement of the top drive to the emergency stop of top drive movement, etc.

Tolerance

The database 142 can store information relating to a tolerance for a given component according to embodiments of the present disclosure. The tolerance can be defined as a distance from the edge of the physical structure of the component 140 and the corresponding edge of the defined zone 141. The nature of the component 140 and the environment in which it is being used can factor into determining an appropriate tolerance. Generally speaking, the faster the speed of the component, the larger the tolerance in the direction of the movement. Alternatively, the faster the speed of the incoming component, the larger the tolerance in the direction of the incoming component. It is also possible that the more sensitive the component, the larger the tolerance can be. The constraints of the environment may also determine what the tolerance is. For example, if the component 140 is to be installed into predefined space where it is next to another component then the tolerance can be adjusted accordingly so as not to trigger an alarm or corrective action when installed in the desired location. In some embodiments the tolerance can be altered during movement. While a given component is stationary the tolerance can be smaller, and when the component 140 is being moved around the rig the zone 141 can be temporarily enlarged and therefore the tolerance altered.

Impact Sensitivity

Various components are made of different materials and some are more delicate than others. The nature of the component's resistance to collision can be factored into the calculation of the zone 141. In some embodiments, the notion of impact sensitivity is more than physical impact, and can include chemical, thermal, vibrational, and electromagnetic contact. The zone of a particular component can be enlarged or reduced according to the sensitivity to contact with other components. For purposes of explanation, consider a component 140 that will suffer damage if the temperature is raised above a predefined threshold. If another component is much hotter and is brought into proximity with the component the systems and methods of the present disclosure can be configured to trigger an alarm or to take corrective action automatically if these two components are brought too close together. Chemical, electromagnetic, and vibrational "contact" can be handled under similar methods. If two components are brought too near to one another, the alarm is triggered.

Reference Point

The component 140 in many embodiments has a physical body and in order to properly address the location of the component 140 and its proximity to other components, the component 140 can be given a reference point and the dimensions of the component 140 can be defined with reference to the reference point. The reference point can be arbitrarily chosen, or it can have some importance. For example the reference point can coincide with the center of mass, an important corner, an edge or another significant point on the component 140. Some components are routinely rotated in which case the reference point and geometry of the component can be updated as it is rotated during service. The zone 141 pertaining to the component can also be updated accordingly. For some components there are attachment points such as hooks, rails, skids, eyelets, bolt patterns, or other physical connection points. This information can also be stored in the database 142 to allow for handling of the components. In the event of an impending collision, information on where an attachment point is located may prove useful and can determine what course of action is taken to prevent or mitigate a collision. Another type of attachment point are ports, such as valves, electrical outlets/ports, etc. Knowing the location and existence of these attachment points and ports can also prove useful and can determine the actions taken by the systems and methods of the present disclosure.

FIGS. 5A-D are illustrations of an interaction of two components being monitored by systems and methods according to embodiments of the present disclosure. The depictions in FIGS. 5A-D are schematic and many details of an interaction between these components are not shown in an effort to clarify aspects of the present disclosure. The figures show a rig structure 150 having a rig surface 152, a first component 154 with a first zone 156 and a second component 158 with a second zone 160. In many applications the rig floor is much more complex than the simple flat surface depicted here, and the components 154, 158 can be more complex and can have more dynamic movements and features than what is shown. It is to be appreciated that these depictions are for illustration and not limitation.

Figure 5A:
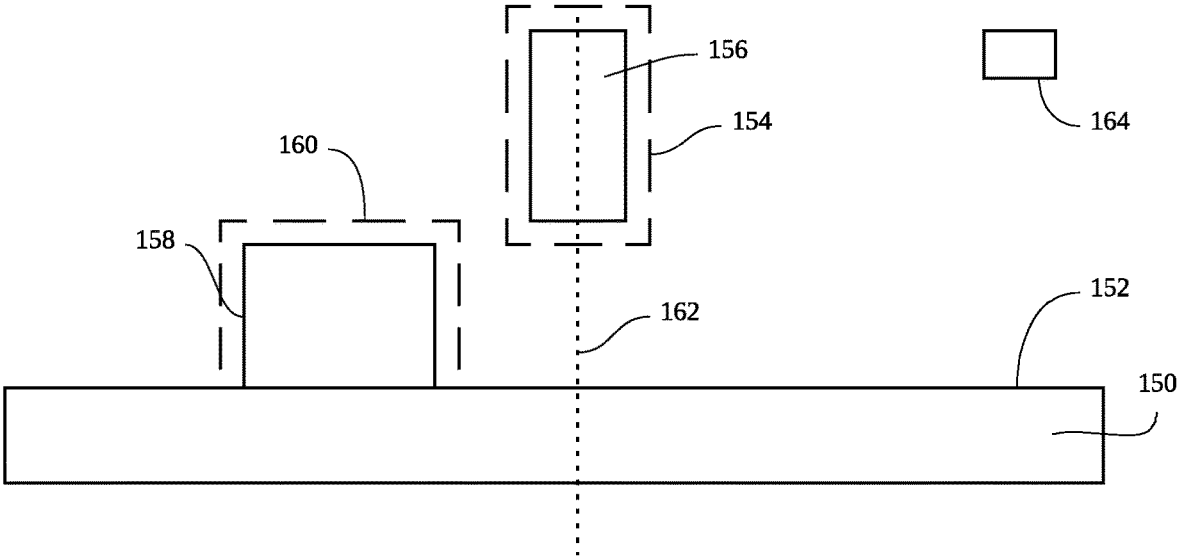
FIGS. 5A-D are illustrations of an interaction of two components being monitored by systems and methods according to embodiments of the present disclosure.
Figure 5B:
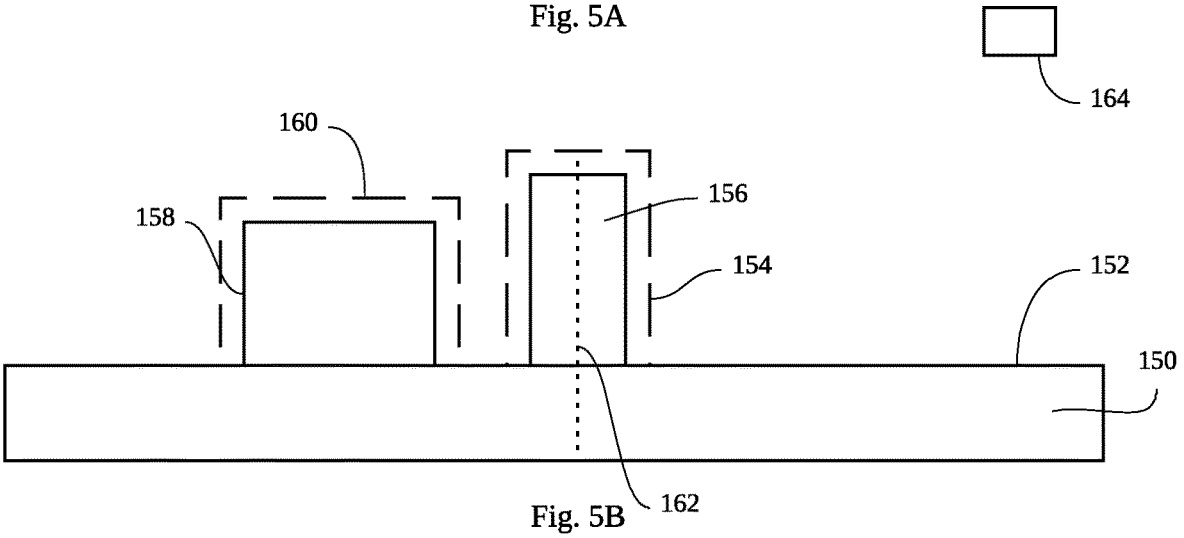

In FIG. 5A the first component 156 is positioned above drill center 162 and the second component 158 is placed on the rig surface 152 and is off to the left of drill center 162. The respective zones for each component are shown. In this position, both components are stationary and the zones are not intersecting. Without any movement, there is no expectation that the two components will collide and therefore no alarm is issued and no preventive action is taken. In FIG. 5B, the first component 156 has moved downward toward the rig floor 152. In some embodiments, before making this move, the first component 156 consults a controller 164 and expand its zone in the direction of the intended movement. The controller 164 evaluates whether there is any intersection between this expanded zone and the zone of the second component 158. The movement of the first component 156 is allowed when no intersection occurs. As the movement of the first component 156 continues, its zone may be adjusted continually depending on the speed of the movement, and the controller 164 continues to check for intersection. When a pending intersection is detected, the controller 164 could initiate actions, such as slowing down or stopping the movement of the first component 156. In some other embodiments, before making this move the first component can consult with a controller 164 to determine whether or not there is anything in the way of the movement. The proposed path of the first component 156 can be described to the controller 164, which contains sufficient logic and data storage pertaining to the coordinate system for the rig and the positions and zones of other components on the rig, at least some of which will have a similar zone as the first and second components. In this case, the controller 164 determined that the path was clear and allowed the first component 156 to move downward onto the rig floor.

Figure 5C:
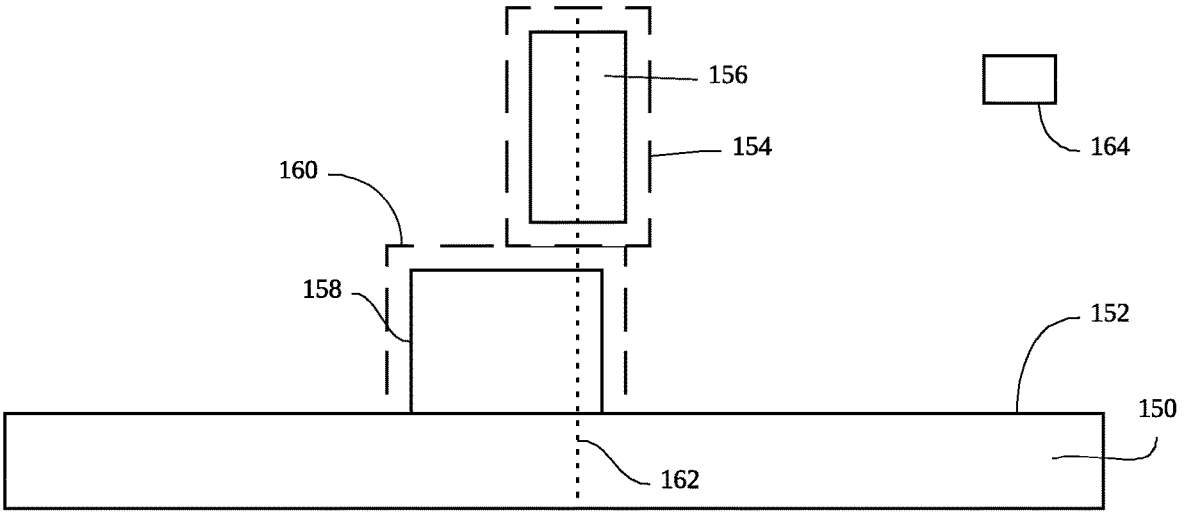

FIG. 5C shows a similar case in which it is the second component 158 that wished to make a move to the right and into position underneath the first component 156. A similar process can be undertaken to determine that there is no problem with this movement.

In some embodiments there is a priority associated with various components. Each component can be given a priority relative to other components and if there are two competing movement proposals, the higher priority can be given the green light and the lesser priority components will have to wait or find another movement path. The higher priority component can be referred to as the commanding component and the lesser component can be referred to as the lesser component or the subservient component.

Figure 5D:
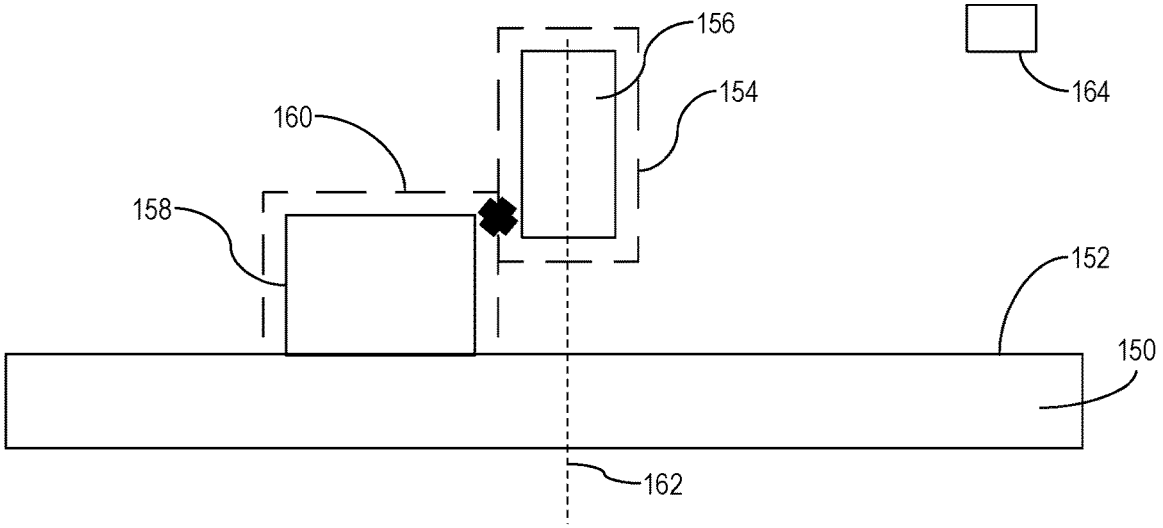

FIG. 5D shows a case in which the two components both desire to move into the same place and an alarm is issued or corrective action is taken according to embodiments of the present disclosure. If the movements shown in FIGS. 5A and 5B were to be taken at the same time, the two components 156, 158 would collide. Before they collide, their zones will intersect. Depending on the size of the zones relative to the components, (the size of the tolerance) the controller (and associated drives, cranes, and other motion-controlling equipment) has time to issue a warning or to take corrective action. Accordingly, the systems and methods of the present disclosure can mitigate or prevent unwanted collisions between components on the rig.

Figure 6:
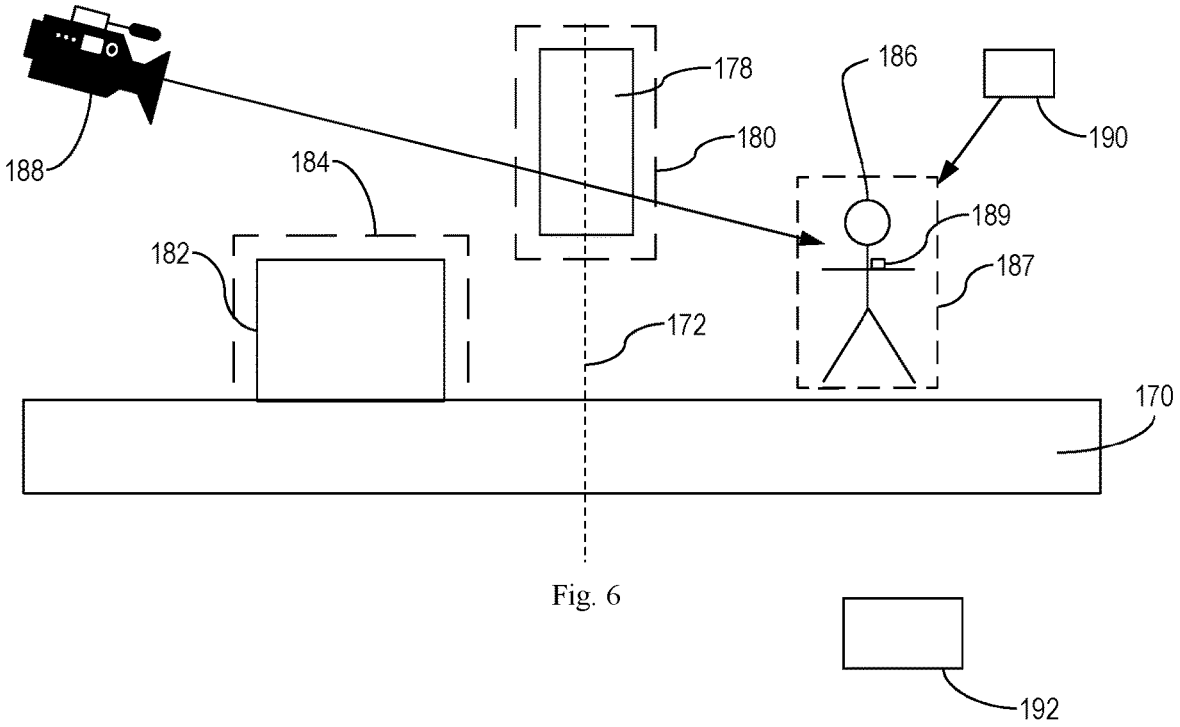
FIG. 6 is a schematic illustration of systems and methods of the present disclosure encountering an unexpected object according to the present disclosure.

FIG. 6 is a schematic illustration of systems and methods of the present disclosure encountering an unexpected object according to the present disclosure. Similar to the scenarios described with respect to FIGS. 5A-5D, a rig floor 170 can have any number of components each having a defined zone and for which the characteristics are known ahead of time. The size and/or shape of the defined zone may change depending on the speed of its associated component. Alternatively, the size and/or shape of the defined zone may change depending on the speed of its surrounding component. A controller 192 can execute the preventive actions described herein with respect to these components. Components 178, and 182 have associated zones 180, and 184, respectively. However, in many circumstances not all objects in such an environment are identified and accounted for before the operation. In this case, a worker 186 has entered the rig floor unexpectedly. The system can include cameras 188 and sensors 190 that can be positioned throughout the rig to identify the presence of the worker 186. The sensors can be thermal, optical, vibrational, and/or electromagnetic, they can include a light curtain, or virtually any other form of sensor used to detect the presence of the worker 186. In other cases the unexpected object can be an inanimate object, such as a pallet, or a crate that was put there without authorization. The sensors 188, 190 can be used to determine the location and movement of the worker 186 and can create a zone 187 around the worker 186. Once this is in place, the controller 192 can treat the worker just like the other components. In some embodiments an unexpected object like the worker 186 will be given high priority due the likely unexpected movement and to reduce the chance for further unexpected actions. In some embodiments the controller 192 can issue a rig-wide alarm and can alert supervising staff to the presence of the worker 186.

In some embodiments the worker 186 can be equipped with a beacon 189 which identifies the worker to the controller 192. In many rig operations, the only people who will be able to enter the rig are employees whose information can be known ahead of time and can be stored in a database. The height, weight, and capabilities of the worker 186 can be known and stored in the database. This information can be useful to execute damage mitigation and prevention procedures. For example, suppose the worker 186 is carrying a beacon which identifies the worker 186 as a skilled technician who can understand certain commands and procedures. Once he is identified, the information can be useful to properly address any risk his presence may present. The beacon 189 can be an RFID tag or any other suitable communications tag or card as is known in the art. In some embodiments, if the worker 186 does not have a beacon the system can initiate a more thorough scanning and measuring process to determine characteristics such as height and weight. Additionally, an unknown individual who has found their way onto the rig is most likely a greater risk to himself and the rig by his presence and according the controller 192 can elevate any alarms or warnings or stop procedures it may have in place.

Figure 7:
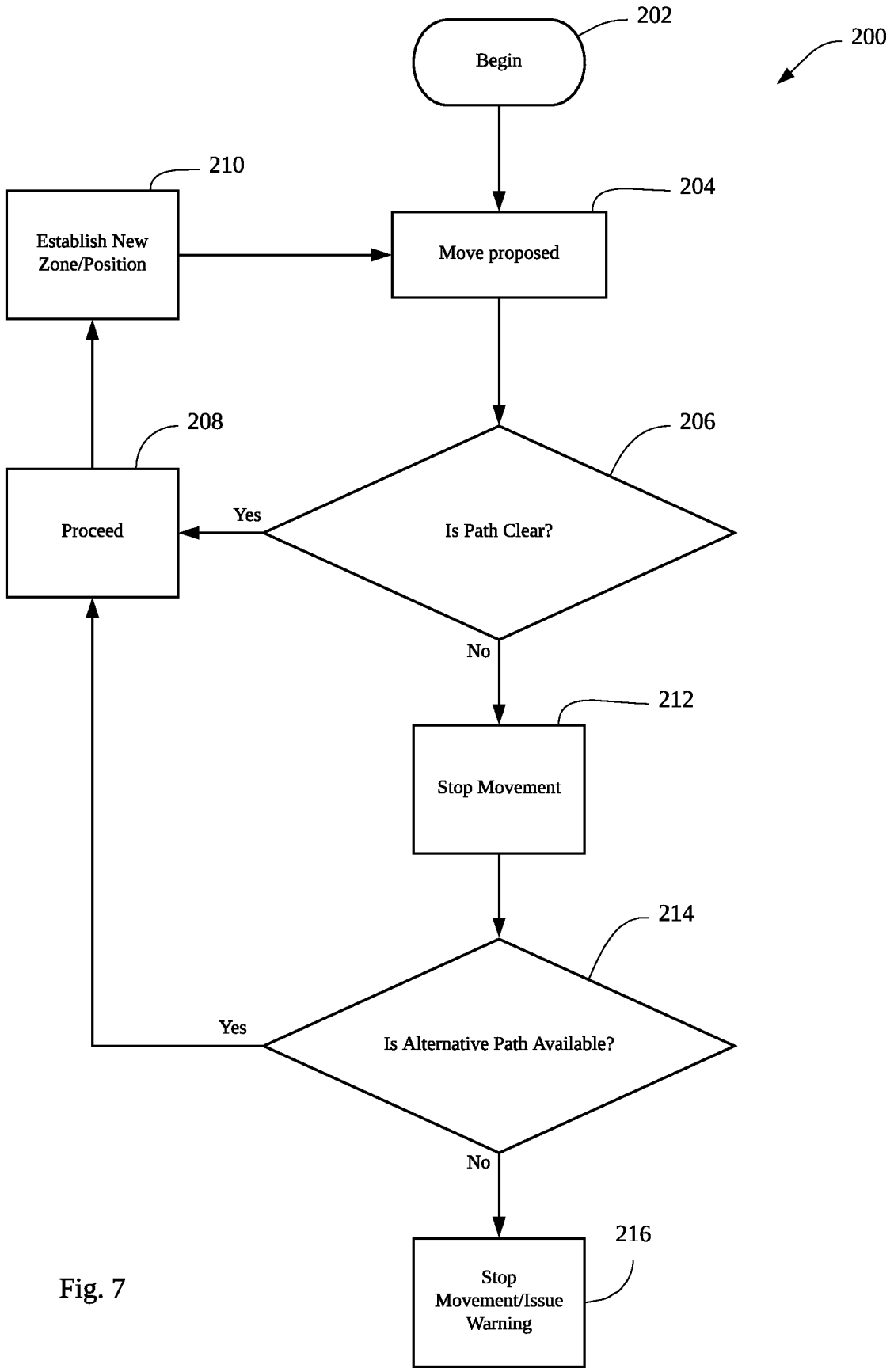
FIG. 7 is a block flow chart illustrating methods according to the present disclosure.

FIG. 7 is a block flow chart illustrating methods 200 according to the present disclosure. In some embodiments, the methods 200 begin at 202 by initializing the systems. This portion of the method 200 can entail documenting or measuring the size and shape of the various components of the rig, and can further include identifying pertinent characteristics of the components—such as chemical, electrical, thermal, and other properties that may be used in determining how to handle these components. At 204 a movement proposal is made. This can be executed by a controller, a computing component, or by sensors on the rig or the components. The move can describe a new location to which the component desires to move. At 206 the method 200 includes a check for whether or not the path is clear for the component to make the proposed move. Determining that the path is clear can include spatial, thermal, chemical, electromagnetic, and other determinations as needed in a given system. In some embodiments, the determination includes a check of the coordinates of the zones of the component that is to make the move and other components on the rig. If there are no conflicting components or zones, the all-clear is given and at 208 the move is executed. At 210 the new position of the component is established. In some embodiments, here the zone cannot be altered. During the movement while there is greater chance for collision, the zone may be expanded. Now that the component is safely put away the zone can be reduced. Of course the opposite can also be true—during movement the component may be at no risk and only once it reaches its destination does the risk increase. In this case the zone may be increased at 210. In any case the zone can be altered to fit the circumstances of the component during any given operation.

If the path is not clear, however, at 212 the method 200 can include stopping movement. In some embodiments in addition to or in place of a stop action the method can include issuing an alarm or informing a supervisor or another automated portion of the system. At 214, the method 200 can further include a check for an alternative path. If there is an alternative path available, the method 200 moves to 208 and the move is executed. If not, at 216 the movement is stopped and the method returns to 204 for a new movement proposal.

Figure 8:
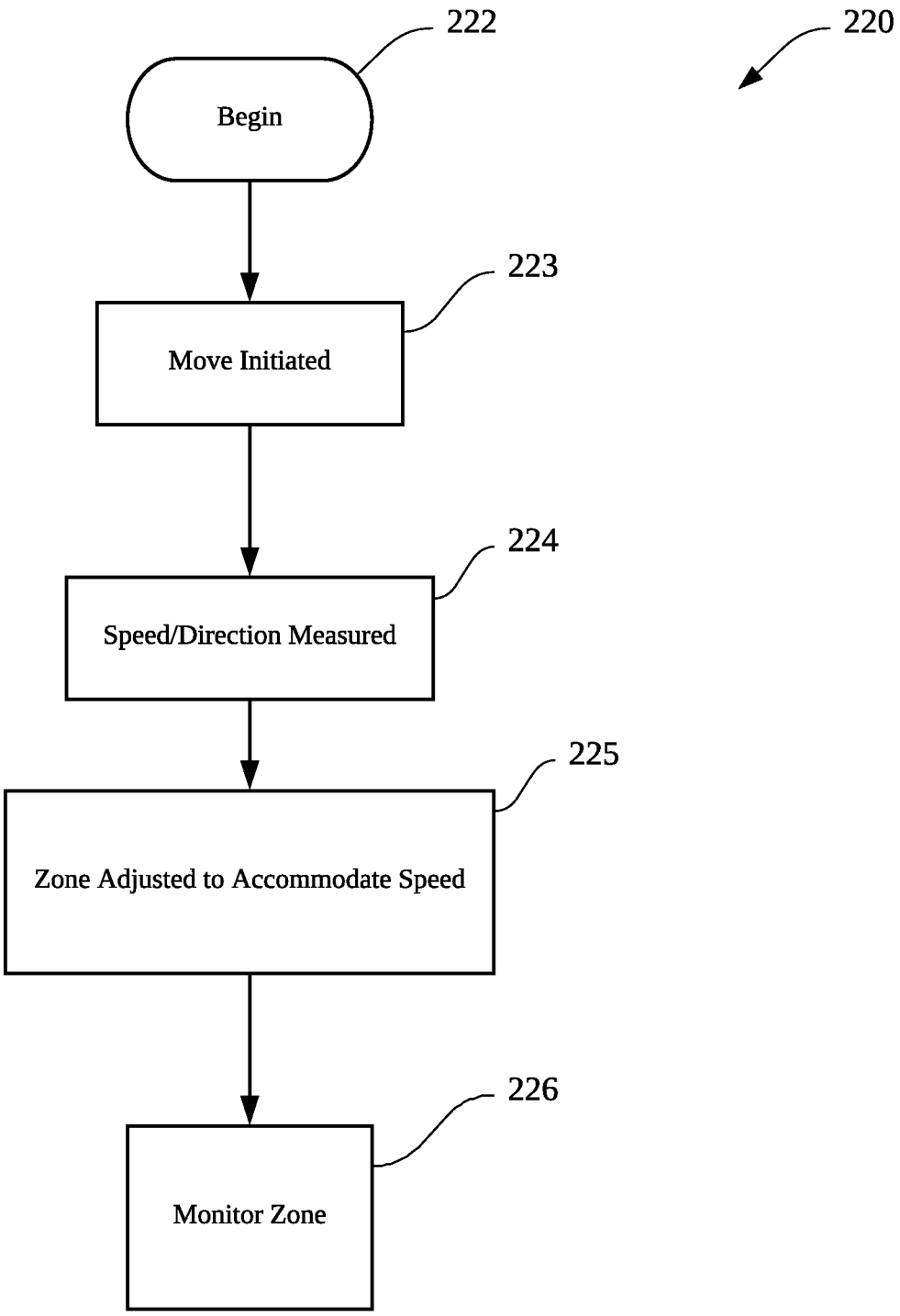
FIG. 8 is a block flow chart diagram of a method according to embodiments of the present disclosure in which motion of an object is taken into account when defining a zone.

FIG. 8 is a block flow chart diagram of a method 220 according to embodiments of the present disclosure in which motion of an object is taken into account when defining a zone. At 222 the method 220 begins. A move is initiated at 223. The move can be initiated by a controller, or by a manual operation or any other equipment configured to move objects around the drill rig. At 224 a speed of the object is identified or measured. The speed can be measured relative to the drill rig or another suitable component such as a truck or dolly upon which the object is carried. The speed and direction of movement can be acquired in a variety of ways, such as by measuring using optical measuring equipment, or from the machinery responsible for moving the equipment itself. At 225 the zone for the object is adjusted to accommodate the measured speed and/or direction. In some embodiments this means that if the object is moving faster, the zone may need to be larger. The direction of movement can be used to alter the zone in the direction of movement more than in other directions. The zone of surrounding objects can also be adjusted. In some embodiments the initial movement of an object is determined and an initial zone is created to account for the first move of the object. The size, shape, and direction of the initial zone can be dependent on the speed at which the object needs to be moved. In some cases the initial zone is approximately the same size as the resting zone of the object, extended in the direction of movement. This process can be iteratively executed using discrete zone explorations to determine whether or not it is safe and clear for the object to move in the desired path. Virtually movement pattern can be constructed of discrete movements by varying the size and shape of the movements as desired.

In some embodiments certain portions of the rig area can be designated as high-traffic areas, low traffic areas, and areas in which personnel may be present. Some areas can be designated as "highways" in which much traffic moves. Due to the frequency of movement in these areas, the size and shape of the zone expansions can be larger (if there are known free-movement zones) or smaller (if the traffic is more variable and more likely to present a collision).

In some embodiments the adjustment to the zones can apply to other zones for other objects which may be implicated by the movement of the object. Objects near the moving object can have their zones adjusted in response to the movement of the object. The degree of adjustment can be determined at least in part based upon the speed of the object. In some embodiments each object has two or more zones: a first zone as described herein to monitor for collision, and a second, larger zone that, when intersecting with another zone or object will initiate a recalculation of the first zone. For example, the object moves as at 223 and soon intersects with a second zone for an object nearby. Triggering this zone causes a recalculation of the other zone for the object, and the recalculation can be based at least in part upon the speed and/or direction of the object. At 226 the zone can be monitored as explained elsewhere herein.

Figure 9:
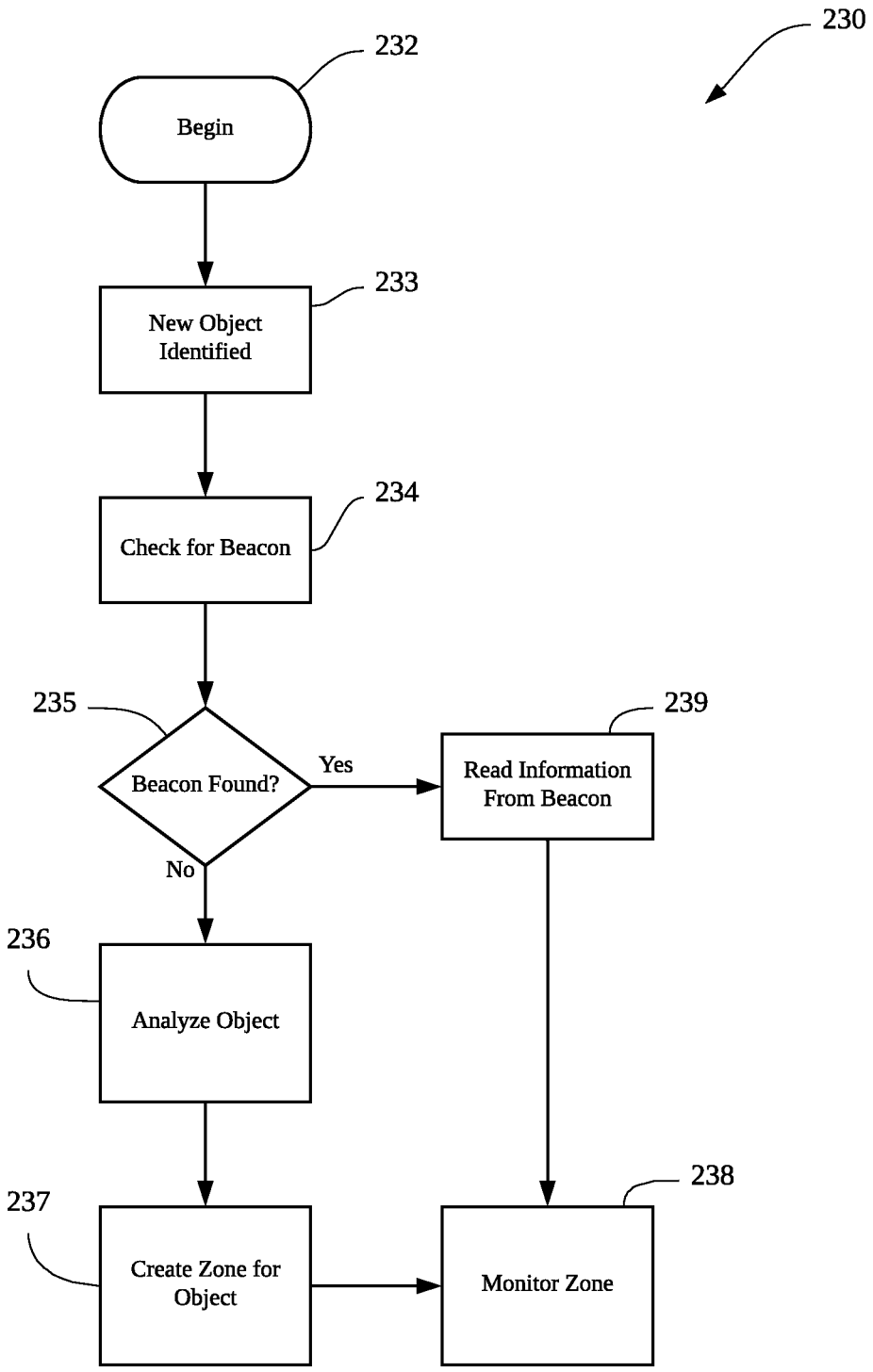
FIG. 9 is a block flow chart diagram according to embodiments of the present disclosure.

FIG. 9 is a block flow chart diagram according to embodiments of the present disclosure. A method 230 can be directed to handling a portable object found on the rig according to embodiments of the present disclosure. At 232 the method includes an initialization which can feature storing certain parameters pertaining to the components on the rig and to calculating and establishing the zones for the different components. At 233 the method includes identifying a portable object within the area under the purview of the systems and methods of the present disclosure. This can be an unauthorized worker wandering onto the rig, a box or pallet placed onto the rig without authorization, or virtually any other means by which an object may find its way onto the rig. Identifying this object can be achieved using sensors, cameras, and other equipment that is used to measure and detect physical characteristics of objects on the rig. At 235 the method can include checking for a beacon or another identifier which can serve to identify the object. If no beacon is found, at 236 the method continues by analyzing the object using the sensors, cameras, or other sensing/monitoring equipment which are present. In some circumstances the object may not be in position for a proper analysis in which case the method can enter a shut-down state to prevent damage or lost time caused by the unidentified object. If the sensors are capable of analyzing the object, at 237 a zone is created for the object in a manner similar to what was described above. The size of the zone may be set to a more conservative, larger size due to the unknown qualities of the object. At 238 control passes to monitoring the zone. This portion of the method 230 can be the methods shown and described with respect to FIG. 7 above, with the zone for the new object being added to the database of objects which are monitored for their position relative to the rig and to other components on the rig under the protection of the systems and methods of the present disclosure. Returning briefly back to 235, if an identifying beacon is in fact found, the information for the object which is stored in the database is accessed and control passes to monitoring the zone for the object at 238.

These methods and systems enable virtually unlimited monitoring of objects or components on the rig, and for the inclusion of new objects. In some embodiments, when new shipments or deliveries of equipment arrive at a rig, the components to be measured can be analyzed at the rig, or the information for each component can be delivered to the controller. Identifying beacons can be placed on the equipment to help identify the objects as they arrive, while the bulk of the information can be delivered via electronic communication means directly to the controller. In other embodiments the beacons themselves carry the information payload and deliver it individually to the controller upon arrival. These methods and systems will help prevent or mitigate collisions or other unwanted contact or proximity of components on a complex and challenging rig environment.

Figure 10:
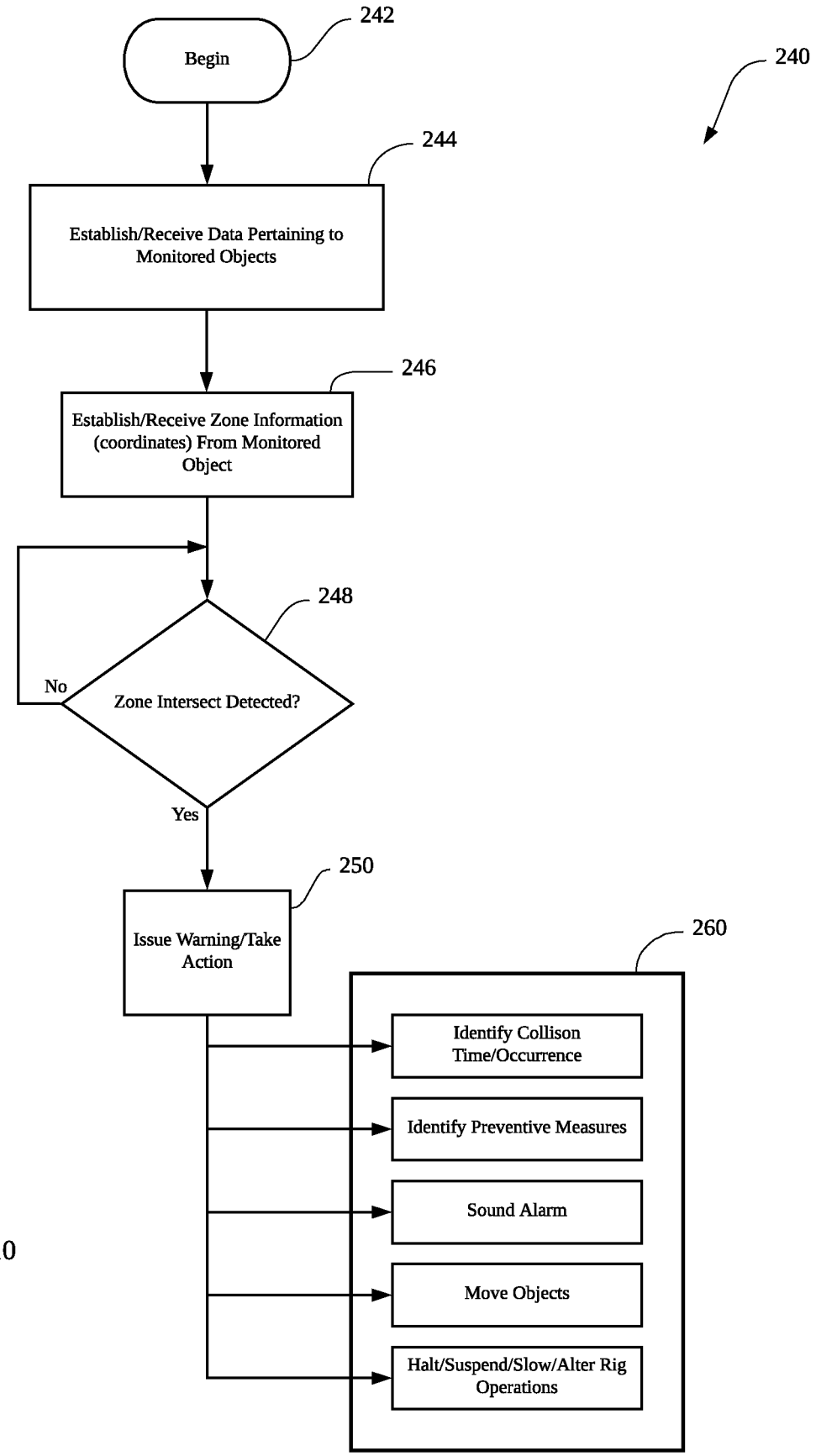
FIG. 10 is another block flow chart showing methods according to embodiments of the present disclosure.

FIG. 10 is another block flow chart showing methods according to embodiments of the present disclosure. At 242 the method begins. At 244 the data for the monitored objects is established or received. This data can be the size, shape, and other parameters for a set of objects to be monitored. The data can be similar to what is described above with respect to FIG. 4. At 246 data pertaining to the zones for the monitored objects is established or received. The zones can be described in terms of coordinates or in another suitable fashion that will allow monitoring of the objects. At 248 a check is performed for whether or not two or more zones have intersected. In the case of x-y-z coordinates, this check can be performed by comparing the coordinates to identify that the zones are intersecting. In some embodiments the zones can be defined large enough such that unless the zones actually intersect no action is taken. In other embodiments, the zones may be defined relatively small such that corrective action is take when the distance between zones is less than a given threshold. In yet other embodiments, there can be multiple zones for a given object, each having a different priority level. In any case, identifying the zones allows the systems and methods of the present disclosure to take action at 250. The action to be taken can be any one or more of multiple actions, including identifying the timing of a collision based on the speed of one or more objects. Using this technique, it can be identified that a collision is imminent, or perhaps that no collision will occur. If the zones encroach, but the objects stop moving, it can be determined that the objects will not collide. An alarm can be sounded locally and/or transmitted electronically locally and/or remotely. In some embodiments a component can be moved to prevent or mitigate any damage that may occur. In yet other embodiments one or more rig operations can be suspended, halted, or slowed in response to the zones intersecting. Safety valves can be triggered, blowout preventers can be actuated, and other measures can be taken to reduce or prevent damage to the rig and release of hydrocarbons into the environment.

Figure 11:
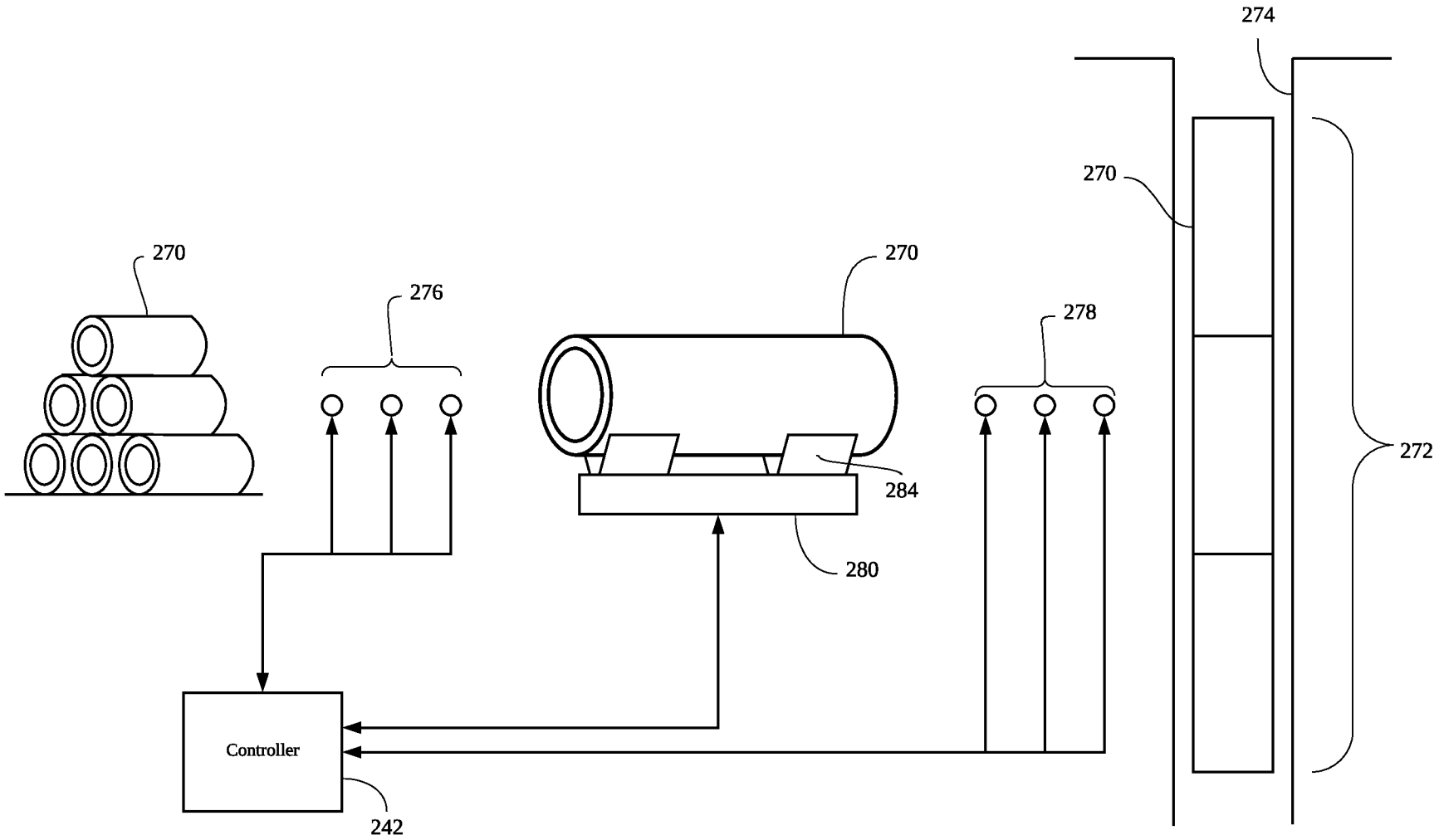
FIG. 11 is a schematic depiction of systems and methods for ensuring proper handling of equipment such as drill string tubulars according to embodiments of the present disclosure.

FIG. 11 is a schematic depiction of systems and methods for ensuring proper handling of equipment such as drill string tubulars according to embodiments of the present disclosure. A drill string is made up of tubular steel conduits 270 (tubulars) which can be fitted with special threaded ends called tool joints. The drill string, which can also be referred to as a drill pipe, connects the rig surface equipment with the bottomhole assembly and the bit, both to pump drilling fluid to the bit and to be able to raise, lower and rotate the bottomhole assembly and bit (not shown). Assembling the drill string presents certain challenges as the tubulars 270 are transported to the rig site by truck or ship in an unassembled state. The tubulars 270 are individually moved from the initial unassembled state toward a final construction 272 shown here in a wellbore 274. Along the way the tubulars 270 are handled by many transporting structures such as elevators, cranes, forklifts, etc. which move the tubulars 270 from storage, to catwalks, to mouseholes, and finally to the wellbore. Several of these transporting/supporting structures are depicted schematically as 276, 278, and 280. A support structure 280 is shown supporting the tubular 270. The supporting structure 280 is shown as a pallet-like structure 282 with upwardly-extending grooves 284 that cradle the tubular 270. It is to be understood that the supporting structure is not shown in a limiting manner, and that the supporting structure 280 can be virtually any type of supporting structure, such as a forklift, a crane, a truck, or even structures usually found in a wellbore such as slips. Any structure used to physically support the weight of the tubular 270 can be used interchangeably with the support structure 280 shown here. Sensors (loadcells, pressure switches, proximity switches, etc.) are installed to provide indication whether a support structure is securely attached to the tubular 270. Support structures 276 and 278 are not depicted in detail to further illustrate that multiple different supporting mechanisms can be used without departing from the scope of the present disclosure. Furthermore, the cargo described in this disclosure is a tubular 270; however, it is to be appreciated that the systems and methods of the present disclosure can be used to transport and store other cargo.

The systems and methods also include a controller 282 which is configured to communicate with support structures 276, 280, and 278. The supporting structures can also be configured to communicate with one another to properly and securely transport the tubulars to their final destination. As the tubular 270 is passed from one support to another, the supports are configured to communicate with one another to ensure that the tubular has proper support throughout the transfer. In many drilling operations, the tubular is "dumb iron" without any electronic equipment or ability to monitor its status.

Figure 12A:
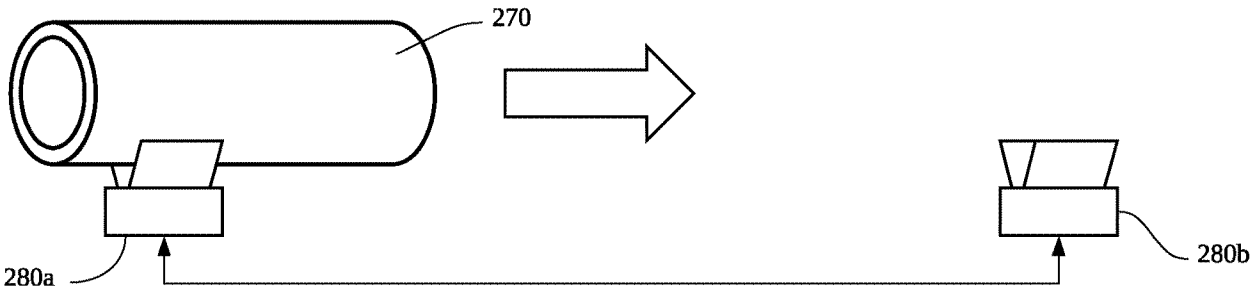
FIGS. 12A-12C illustrate an exchange of control between two supporting structures according to embodiments of the present disclosure.
Figure 12B:
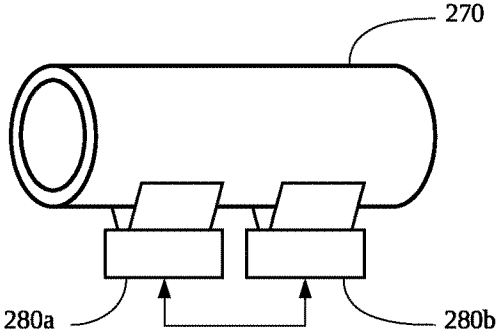
Figure 12C:
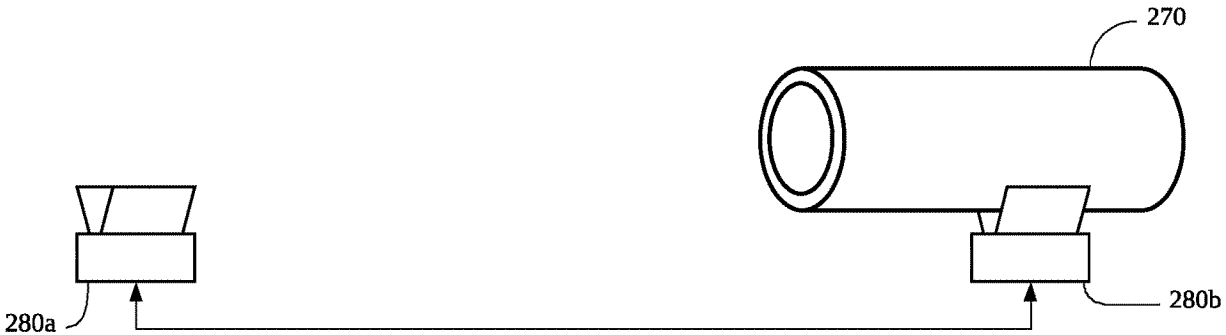

FIGS. 12A-12C illustrate an exchange of control between two supporting structures 280*a* and 280*b* according to embodiments of the present disclosure. In FIG. 12A, the tubular 270 is carried by a first support 280*a* which is intended to transfer the tubular 270 to a second support 280*b*. The supports 280*a* 280*b* can be configured to communicate with one another to execute the transfer. In some embodiments these communications can be coordinated through a controller (not shown) which sends and receives communications between the supports 280*a* and 280*b* like a relay. The first support 280*a* can ping the second support 280*b* to alert the second support 280*b* of the incoming load. The second support 280*b* can respond with an acknowledgement. If the acknowledgement is late or is not given the first support 280*a* can communicate this breakdown to a controller or other exception-handling systems that can be implemented. In fact, at any point during the communication between supports 280*a* and 280*b* a breakdown can be reported at which point remedial steps can be taken.

The first support 280*a* can deliver information to the second support 280*b*, such as the size, shape, and weight of the load to be delivered. The second support 280*b* can respond with affirmation of its capabilities to handle the load. These communications can help to avoid attempting to transfer something to a destination that is ill-equipped to handle the load. Once the supports 280*a*, 280*b* agree upon the transfer, the transfer can begin. FIG. 11B shows the tubular 270 in the process of transferring between the supports. It is to be appreciated that the particulars of the transfer can vary without departing from the scope of the present disclosure. Throughout the transfer process the supports can communicate to verify that the load is properly supported. In some cases the nature of the transporting structures dictates that the transfer is a multi-step process in which case there can be multiple points at which the supports can exchange information to be sure the load is supported properly. In FIG. 12B, for example, the tubular 270 is supported equally by both supports 280*a*, 280*b* for at least a short time. FIG. 11C shows the tubular 270 fully transferred to the support 280*b*. Once again the communication between the supports eliminates the chance that the tubular 270 will be without proper support. In some embodiments, the first support 280*a* can be configured not to release the tubular 270 until the second support 280*b* confirms that it has full support of the tubular 270, such that there is at least a partial overlap or redundancy to the support.

FIG. 13A illustrates a tubular 270 and a support 280 according to embodiments of the present disclosure. The tubular 270 and the support 280 can each have zones 290 and 292 in a manner similar to what is described elsewhere herein. The zones may be larger than the equipment to which they pertain to enable detection of proximity. Alternatively, the zones may be sized as close to the actual size of the equipment to enable detection of proximity and the desired extent of intersection. The zones and the monitoring equipment can be used with tubulars and supports like those shown here. In this case the intersection of zones can be a sought-after result that allows for handling of tubulars and other equipment. For example, when it is time to load the tubular 270 onto the support 280, machinery can bring them toward one another. When the zones intersect, it indicates proximity. Once the tubular 270 is in range of the support 280, the tubular 270 and support 280 can be coupled. It is to be appreciated that the tubular 270 can be replaced with any equipment to be carried or moved about the rig site and the support 280 can be any one of many types of loading, conveying, and supporting equipment. Depending on specific equipment design, the desired extent of the intersection of the zones 290 and 292 can cause the support 280 to initiate a transfer routine through which the support 280 takes control of the tubular 270. This can include clasping of fasteners, actuation of mechanical arms, closures, clasps, or magnetic closures, or other coupling mechanisms whatever they may be in a given installation. Once the tubular 270 is carried by the support 280, a new zone 294 can be created to encompass both the tubular and support. The new zone 294 can be treated as one of many zones according to embodiments of the present disclosure and can be monitored for proximity and intersection with other zones.

FIG. 13B shows a composite zone 294, a tubular 270, and a support 280 and a second support 296 and corresponding zone 298 according to embodiments of the present disclosure. The zones 294 and 298 are just coming into contact. Their intersection can be monitored by a central system which can initiate a transfer sequence through which the tubular 270 will be transferred from the support 280 to the support 296. The zones 294 and 298 can intersect along an edge or in a corner to alert the system of the proximity of the two objects.

FIG. 13C shows a transfer sequence between the first support 280 and the second support 296. The supports can exchange information during the hand-off to be sure the second support 296 has control before the first support 280 releases control. During the transition, the tubular 270 can maintain its zone and can be monitored by the central system to facilitate the transfer and to ensure that the tubular 270 stays in position relative to the supports 280, 296. In some embodiments there can be an established path for the transfer of the tubular 270. During the transition, the position of the tubular 270 can be monitored and compared against the expected path. Similarly, the sensors (not shown)

indicating whether the first and second supports 280 and 296 have securely attached to the tubular can be monitored to ensure the second structure 296 is securely attached to the tubular before releasing the tubular from the first support structure 280. If there is a deviation greater than some small, tolerated amount, an alarm can sound or the transition can be halted or slowed or otherwise altered to prevent damage to the equipment and to ensure an efficient transition.

Figure 14:
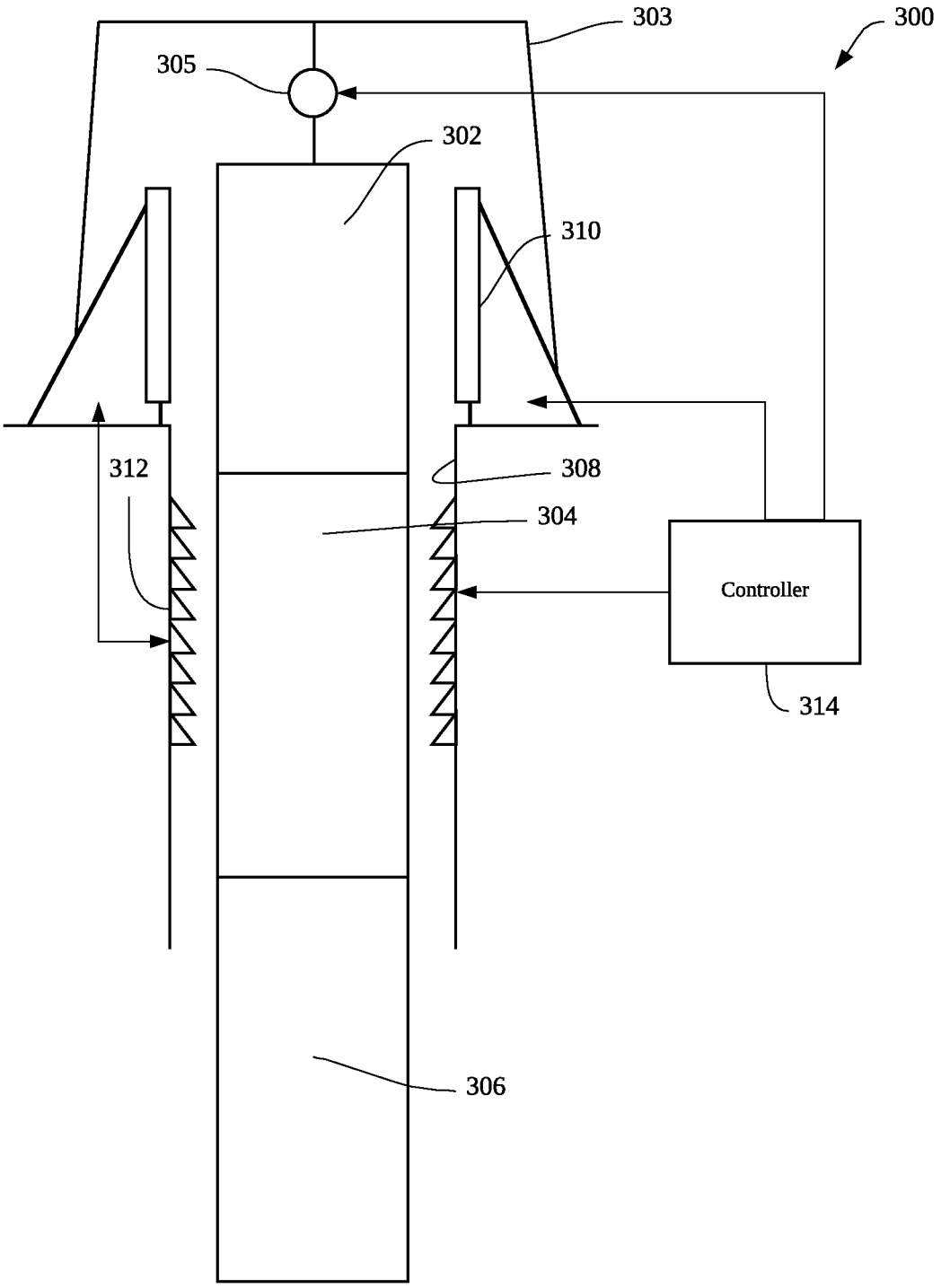
FIG. 14 is an illustration of a system for handling a series of tubulars in a well that are supported by various supporting structures according to embodiments of the present disclosure.

FIG. 14 is an illustration of a system 300 for handling a series of tubulars in a well 308 that are supported by various supporting structures according to embodiments of the present disclosure. Tubulars 302, 304, and 306 are deployed in a drillstring in a vertical, end-to-end fashion. Tubulars generally have threaded ends or other interlocking mechanisms that allow the tubulars to connect to on another. The system 300 includes an above-ground support 310 which is capable of supporting the weight of the drillstring as it is suspended in the well. The system 300 can include an overhead support 303 and a hoist 305 which holds the tubulars. The system 300 can also include slips 312 positioned in the wellbore 308. The slips 312 can also support the weight of the drillstring through the above-ground support 310. The slips 312 can be found on many types of equipment depending on the way the well is completed. The present disclosure includes any suitable type of slips or other tubular-affixing mechanisms.

As the drillstring is constructed, successive tubulars are attached to the drillstring above ground and the drillstring is lowered into the well 308. As this process is carried out, from time to time the weight of the drillstring needs to be supported by different components. The above-ground support 310 and slips 312 can communicate with one another to ensure that the drillstring is always supported. In some embodiments the slips 312 and above-ground support 310 are examples of the supports shown and described elsewhere herein. In some embodiments the slips 312 and above-ground support 310 can require a period of redundant support before either one releases. For example, suppose the above-ground support 310 is carrying the weight of the drillstring via the hoist 305. It can communicate with the slips 312 (or with another component controlling the slips) and confirm that the slips 312 are also supporting the drillstring before letting go. Accordingly, there is a period of redundant support. The communication can take place between the slips 312 and above-ground support 310 directly, or it can happen via an intermediary controller 314.

Figure 15:
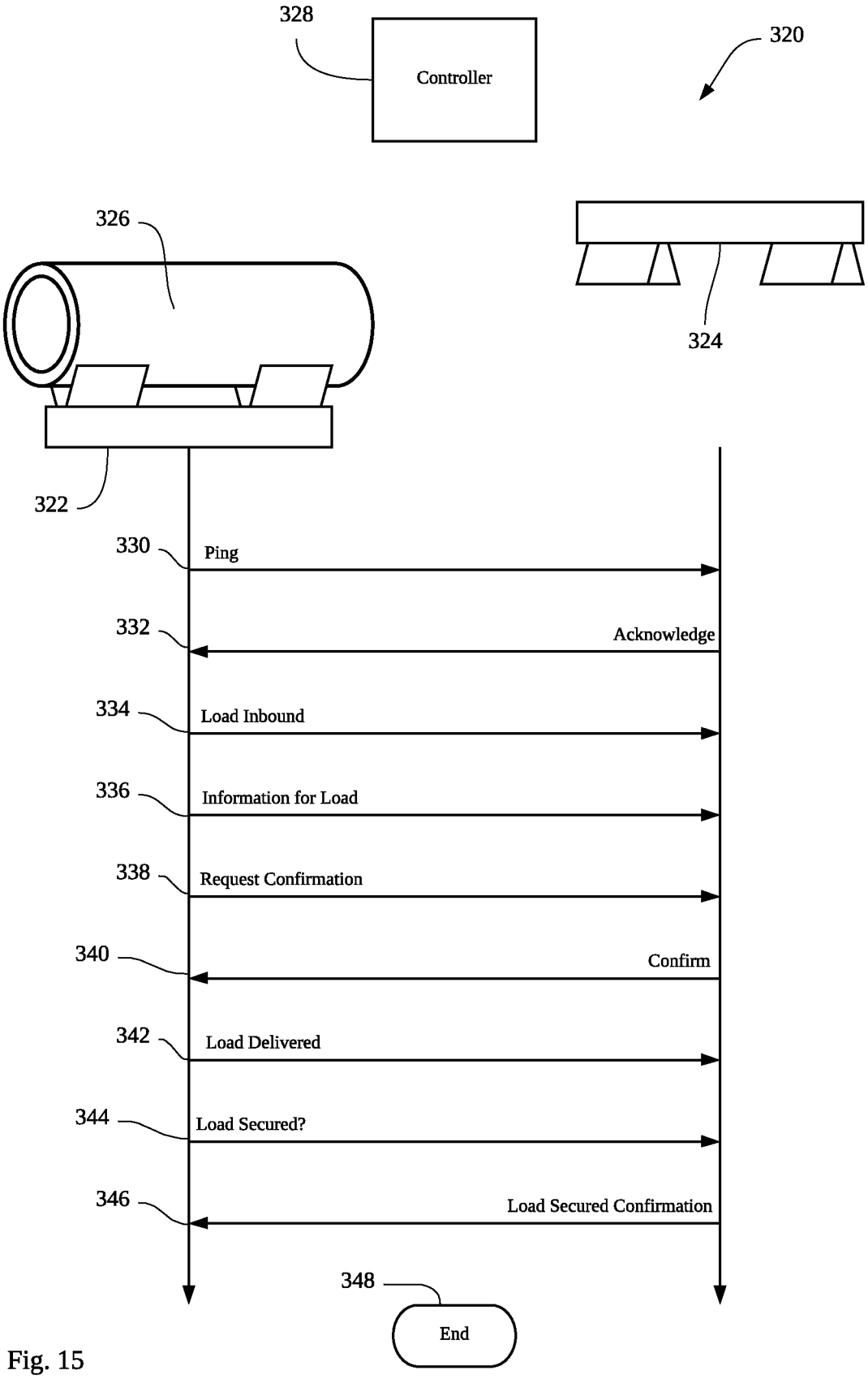
FIG. 15 is a swim-lane diagram showing an interaction between supports and for a load such as a tubular according to embodiments of the present disclosure.

FIG. 15 is a swim-lane diagram showing an interaction 320 between supports 322 and 324 for a load such as a tubular 326 according to embodiments of the present disclosure. The first support begins this process with the tubular 326 secured thereto, and the second support 324 is unladen and is to receive the tubular 326. In certain embodiments, the first support 322 initiates contact with a ping at 330. In other embodiments, the transaction is initiated by an identified intersection between zones. At 332 an acknowledgement is issued from the second support 332. At 334 the first support can tell declare the intention to deliver the load. At 336 the first support can deliver information describing the load, such as weight, shape, size, identification no., etc. The first support 322 can request a confirmation at 338 that the information checks out and that the second support 324 is able to receive the load. At 340 the second support 324 confirms. The transfer of the load can be carried out in various methods depending on the nature of the supports and the load at 342. At 344 the first support 322, before releasing the load, can request an assurance that the load is secured. At 346 the second support grants the request and confirms that the load is secured. The transition is complete at 348.

At any of these points (and even perhaps during one of them) if an error occurs the system can be configured to issue an alarm or to initiate loss prevention measures. For example, if the second support fails to acknowledge in time that it is ready to receive the load, the process can be given to an exception handling process. It is also to be appreciated that the processes and methods of the present disclosure are not limited to the description given here and the steps are not necessarily all required in a given installation. Certain steps can be combined, eliminated, reduced, or altered, or they can be performed in a different order. These communications can take place directly between the two supports, or they can be delivered via a controller 328. In some embodiments there are three or more supports which operate together to achieve a similar outcome. Perhaps one such support comprises two or more components that both receive a load. The three supports can work together to secure the load and prevent damage and loss. Other embodiments will become clear to a person of ordinary skill in the art.

Figure 16:
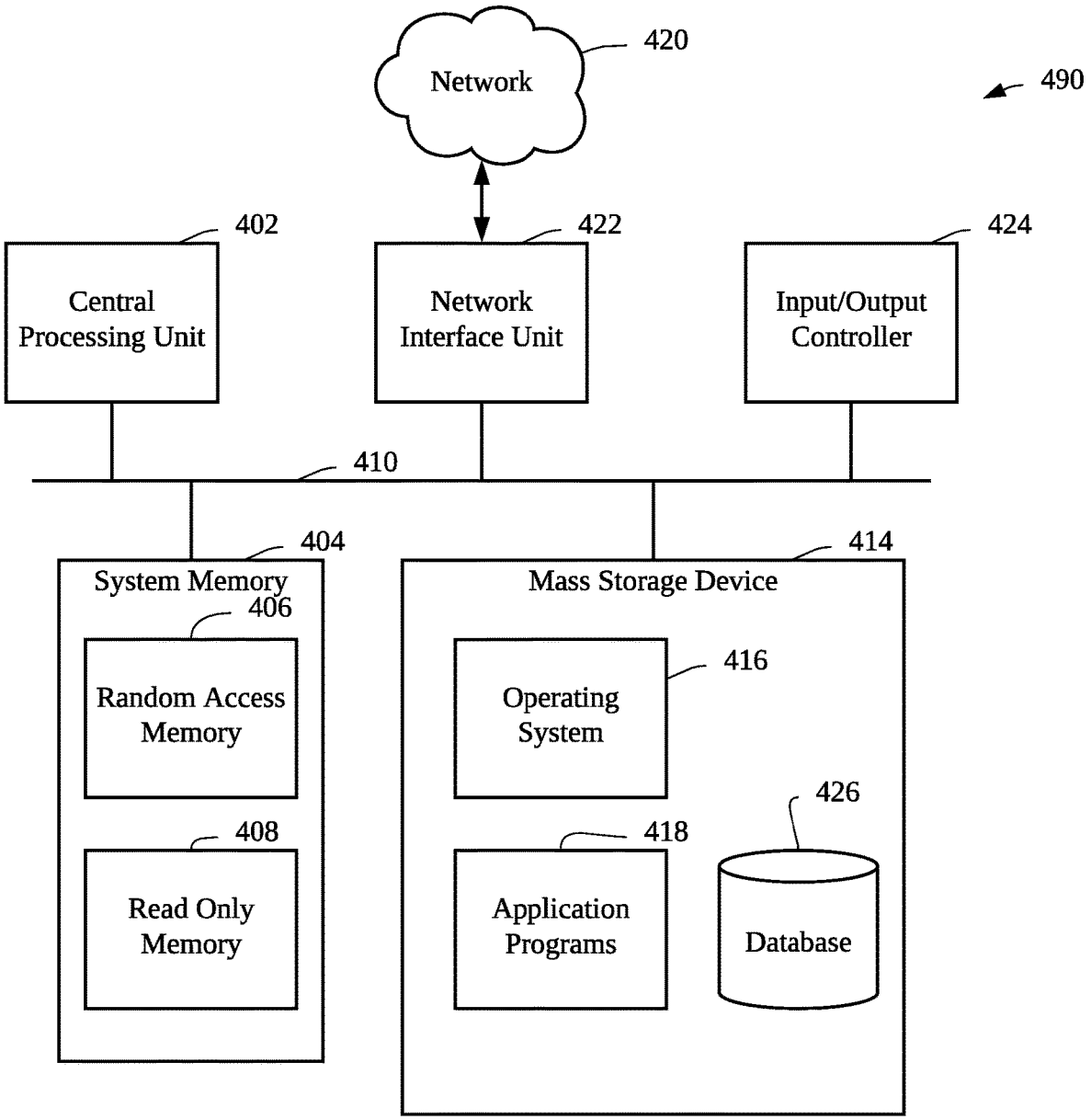
FIG. 16 is a block diagram of an operating environment for implementations of computer-implemented methods according to embodiments of the present disclosure.

Referring now to FIG. 16, an illustrative computer architecture for a computer 490 utilized in the various embodiments will be described. The computer architecture shown in FIG. 16 may be configured as a desktop or mobile computer and includes a central processing unit 402 ("CPU"), a system memory 404, including a random access memory 406 ("RAM") and a read-only memory ("ROM") 408, and a system bus 410 that couples the memory to the CPU 402.

A basic input/output system containing the basic routines that help to transfer information between elements within the computer, such as during startup, is stored in the ROM 408. The computer 490 further includes a mass storage device 414 for storing an operating system 416, application programs 418, and other program modules, which will be described in greater detail below.

The mass storage device 414 is connected to the CPU 402 through a mass storage controller (not shown) connected to the bus 410. The mass storage device 414 and its associated computer-readable media provide non-volatile storage for the computer 490. Although the description of computer-readable media contained herein refers to a mass storage device, such as a hard disk or CD-ROM drive, the computer-readable media can be any available media that can be accessed by the computer 490. The mass storage device 414 can also contain one or more databases 426.

By way of example, and not limitation, computer-readable media may comprise computer storage media and communication media. Computer storage media includes volatile and non-volatile, removable and non-removable media implemented in any method or technology for storage of information such as computer-readable instructions, data structures, program modules or other data. Computer storage media includes, but is not limited to, RAM, ROM, EPROM, EEPROM, flash memory or other solid state memory technology, CD-ROM, digital versatile disks ("DVD"), or other optical storage, magnetic cassettes, magnetic tape, magnetic disk storage or other magnetic storage devices, or any other medium which can be used to store the desired information and which can be accessed by the computer 490.

According to various embodiments, computer 490 may operate in a networked environment using logical connections to remote computers through a network 420, such as the Internet. The computer 490 may connect to the network 420 through a network interface unit 422 connected to the bus 410. The network connection may be wireless and/or wired. The network interface unit 422 may also be utilized to connect to other types of networks and remote computer systems. The computer 490 may also include an input/output controller 424 for receiving and processing input from a number of other devices, including a keyboard, mouse, or electronic stylus (not shown in FIG. 16). Similarly, an input/output controller 424 may provide output to a display screen, a printer, or other type of output device (not shown).

As mentioned briefly above, a number of program modules and data files may be stored in the mass storage device 414 and RAM 406 of the computer 490, including an operating system 416 suitable for controlling the operation of a networked personal computer. The mass storage device 414 and RAM 406 may also store one or more program modules. In particular, the mass storage device 414 and the RAM 406 may store one or more application programs 418.

The foregoing disclosure hereby enables a person of ordinary skill in the art to make and use the disclosed systems without undue experimentation. Certain examples are given to for purposes of explanation and are not given in a limiting manner.

The invention claimed is:

1. A system, comprising:

a plurality of monitored objects, each having physical characteristics, the monitored objects being deployed in a workspace;

a computation component configured to establish zones pertaining to one or more of the monitored objects, wherein size and shape of each zone is based on the physical characteristics of a corresponding one of the monitored objects;

a memory configured to store a coordinate system for the workspace and for the monitored objects and to store information describing the zones;

wherein:

the zones extend beyond a physical extremity of the monitored object in at least one direction;

the computation component is configured to identify that zones for two or more monitored objects will intersect, to initiate preventive measures in response to the zones intersecting, and to establish a first zone and a second zone for the monitored objects, the first zone being smaller than the second zone, wherein the preventive measures initiated by the computation component in response to identifying that the second zone has intersected with another zone comprise expanding the first zone.

2. The system of claim 1 wherein the computation component is further configured to acquire a speed pertaining to a monitored object and wherein expanding the first zone comprises expanding the first zone commensurately with the speed.

3. A system, comprising:

a plurality of monitored objects, each having physical characteristics, the monitored objects being deployed in a workspace;

a computation component configured to establish zones pertaining to one or more of the monitored objects, wherein size and shape of each zone is based on the physical characteristics of a corresponding one of the monitored objects;

a memory configured to store a coordinate system for the workspace and for the monitored objects and to store information describing the zones;

wherein:

the zones extend beyond a physical extremity of the monitored object in at least one direction;

the computation component is configured to identify that zones for two or more monitored objects will intersect, to initiate preventive measures in response to the zones intersecting, and to calculate a speed of one or more of the monitored objects and to alter a zone pertaining to stationary objects near the monitored object based on the calculated speed of the one or more of the monitored objects.

4. A system, comprising:

a plurality of monitored objects, each having physical characteristics, the monitored objects being deployed in a workspace;

a computation component configured to establish zones pertaining to one or more of the monitored objects, wherein size and shape of each zone is based on the physical characteristics of a corresponding one of the monitored objects;

a memory configured to store a coordinate system for the workspace and for the monitored objects and to store information describing the zones;

wherein:

the zones extend beyond a physical extremity of the monitored object in at least one direction;

the computation component is configured to identify that zones for two or more monitored objects will intersect, to initiate preventive measures in response to the zones intersecting, and to establish an initial zone of movement for the object, the initial zone of movement being adjacent to the object, and wherein the computation component is configured to confirm that no other zone occupies the initial zone of movement.

5. The system of claim 4 wherein the computation component is configured to iteratively establish successive zones of movement and to confirm that each successive zone is not occupied by another zone.

6. A method, comprising:

identifying a coordinate system for a workspace;

identifying a plurality of monitored objects within the workspace, wherein at least one of the monitored objects is equipped with a beacon storing information indicative of physical characteristics of the monitored object equipped with the beacon;

receiving from the beacon the information indicative of physical characteristics;

establishing coordinates for the monitored objects pertaining to the coordinate system for the workspace;

establishing a zone for one or more monitored objects, the zone extending beyond a perimeter of the monitored object such that a buffer is defined between the zone and the monitored object, wherein size and shape of the zone is based on the information stored in the beacon;

identifying intersection of two or more zones; and initiating preventive measures in response to the intersection.

7. The method of claim 6 wherein the zone extends beyond a perimeter of the monitored object in a direction of intended movement for the object.

8. The method of claim 7 wherein the zone extends beyond a perimeter of the monitored object a distance proportional to a speed at which the monitored object will move.

9. The method of claim 6, further comprising acquiring a speed of one or more of the monitored objects, and altering the zone to accommodate the speed.

10. The method of claim 6, further comprising calculating a time of impact between the two or more monitored objects pertaining to the intersecting zones.

11. The method of claim 6 wherein preventive measures comprise one or more of sounding an alarm, moving one or more objects in the workspace, and altering operation of equipment within the workspace.

12. The method of claim 6, further comprising identifying a new object entering the workspace and identifying coordinates and a zone for the new object, wherein the new object is equipped with a new beacon storing information indicative of physical characteristics of the new object equipped with the new beacon.

13. The method of claim 12, wherein the preventive measures include procedures specific to the new object according to the information in the new beacon.

14. The method of claim 6 wherein establishing the zone comprises establishing limits on one or more of physical space, temperature, vibration, radiation, chemical properties, and electromagnetic energy.

* * * * *